US006692879B2

(12) United States Patent
Suzuki et al.

(10) Patent No.: US 6,692,879 B2
(45) Date of Patent: Feb. 17, 2004

(54) THERMAL TRANSFER RECORDING MATERIAL

(75) Inventors: Shino Suzuki, Shinjuku-Ku (JP); Masahiro Yuki, Shinjuku-Ku (JP); Takenori Omata, Shinjuku-Ku (JP); Munenori Ieshige, Shinjuku-Ku (JP); Hidemasa Kaida, Shinjuku-Ku (JP)

(73) Assignee: Dai Nippon Printing Co., Ltd. (JP)

( * ) Notice: Subject to any disclaimer, the term of this patent is extended or adjusted under 35 U.S.C. 154(b) by 0 days.

(21) Appl. No.: 10/258,217

(22) PCT Filed: Mar. 8, 2002

(86) PCT No.: PCT/JP02/02202

§ 371 (c)(1),
(2), (4) Date: Oct. 21, 2002

(87) PCT Pub. No.: WO02/072363

PCT Pub. Date: Sep. 19, 2002

(65) Prior Publication Data

US 2003/0203293 A1 Oct. 30, 2003

(30) Foreign Application Priority Data

Mar. 9, 2001 (JP) ..... 2001-66111
Jul. 2, 2001 (JP) ..... 2001-200861
Mar. 31, 2002 (JP) ..... 2002-22731

(51) Int. Cl.[7] ..... G03C 8/10; G03C 8/26; G03C 1/725; B41M 5/38; B41M 5/39

(52) U.S. Cl. ..... 430/17; 430/941; 430/964; 430/201; 503/227; 428/447; 428/532

(58) Field of Search ..... 430/201, 964, 430/213, 941, 17, 18; 428/447, 532; 503/227

(56) References Cited

U.S. PATENT DOCUMENTS 5,045,524 A * 9/1991 Chapman et al. ..... 430/201

(List continued on next page.)

FOREIGN PATENT DOCUMENTS

EP 0 550 817 A2 7/1993

(List continued on next page.)

*Primary Examiner*—Richard L. Schilling
(74) *Attorney, Agent, or Firm*—Parkhurst & Wendel, L.L.P.

(57) ABSTRACT

There is provided a thermal transfer image-receiving sheet which has dyeability high enough to realize high-speed printing and low-energy printing, permits a protective layer to be thermally transferred onto an image formed on the thermal transfer image-receiving sheet, is free from heat fusing to a thermal transfer sheet at the time of image formation on the thermal transfer image-receiving sheet, and has satisfactory separability from the thermal transfer sheet. The thermal transfer image-receiving sheet comprises: a substrate sheet; and a receptive layer provided on at least one side of the substrate sheet, said receptive layer comprising at least a combination of a cellulose ester resin (A) having a degree of acetylation of 10 to 30% with a cellulose ester resin (B) having a degree of acetylation of less than 6%, the total degree of acetylation of the cellulose ester resin (A) and the cellulose ester resin (B) being 8 to 14%, the content of hydroxyl groups in the cellulose ester resin (A) and the content of hydroxyl groups in the cellulose ester resin (B) each being not more than 6% by weight, the remaining hydroxyl groups having been esterified with an organic acid excluding acetic acid. By virtue of the above construction, the thermal transfer image-receiving sheet can realize printing of an image thereon with high dyeability at a high speed, has excellent separability from a thermal transfer sheet, is free from smudge and blurring derived from plasticizers, and permits a protective layer to be adhered onto the receptive layer.

24 Claims, 2 Drawing Sheets

U.S. PATENT DOCUMENTS

| | | | | | |
|---|---|---|---|---|---|
| 5,106,816 | A | | 4/1992 | Morohoshi et al. | 503/227 |
| 5,278,130 | A | | 1/1994 | Arita et al. | 503/227 |
| 5,356,859 | A | | 10/1994 | Lum et al. | 503/227 |
| 5,393,725 | A | | 2/1995 | Abe et al. | 503/227 |
| 5,432,040 | A | * | 7/1995 | Defieuw et al. | 434/201 |

FOREIGN PATENT DOCUMENTS

| | | |
|---|---|---|
| JP | 64-34792 | 2/1989 |
| JP | 3-178484 | 8/1991 |
| JP | 4-138288 | 5/1992 |
| JP | 5-262055 | 10/1993 |
| JP | 7-52563 | 2/1995 |
| JP | 7-242071 | 9/1995 |
| JP | 2000-309172 | 11/2000 |
| JP | 2001-18539 | 1/2001 |

* cited by examiner

THERMAL TRANSFER RECORDING MATERIAL

TECHNICAL FIELD

The present invention relates to a thermal transfer recording material and particularly to a thermal transfer image-receiving sheet which can yield images with high dyeability, is free from heat fusing to a thermal transfer sheet at the time of image formation, and has satisfactory separability from the thermal transfer sheet.

BACKGROUND ART

Various thermal transfer methods are known in the art. One of them is a method wherein sublimation-transferable dyes are provided as recording agents and are thermally transferred from a thermal transfer sheet comprising a substrate sheet, such as a polyester film, bearing thereon these dyes onto an object colorable with a sublimable dye, for example, an image-receiving sheet comprising a receptive layer provided on paper, a plastic film or the like to form various full-color images.

In this case, a thermal head in a printer is used as heating means, and a large number of color dots of three or four colors with regulated heat quantity are transferred onto the image-receiving sheet by heating in a very short time, whereby full color of an original is reproduced by multicolor dots.

Since colorants used are dyes which are very vivid and highly transparent, the formed images have excellent reproduction of intermediate colors and gradation and have high quality which is equal to images produced by conventional offset printing and gravure printing and is comparable to the quality of full-color photographic images.

What is important for effectively carrying out the thermal transfer method is the construction of the thermal transfer sheet, as well as the construction of the image-receiving sheet on which an image is to be formed. Regarding conventional image-receiving sheets, for example, Japanese Patent Laid-Open Nos. 169370/1982, 207250/1982, and 25793/1985 disclose resins for the receptive layer. Specifically, vinyl resins, such as polyvinyl chloride resins, polyvinyl butyral resins, acrylic resins, cellulosic resins, olefin resins, polystyrene resins, polyester resins, polycarbonate resins and the like are disclosed as resins for the formation of the receptive layer.

In recent years, an improvement in printing speed (high-speed printing), which can shorten printout time per sheet, and power saving (low energy) printing, which can be driven by batteries for portable convenience, have become demanded. A receptive layer formed of a vinyl chloride-vinyl acetate copolymer resin is preferred as the receptive layer for high-speed printing and low-energy printing, because satisfactory density can be provided and, in addition, at the time of thermal transfer, abnormal transfer such as fusing does not occur between the thermal transfer sheet and the thermal transfer image-receiving sheet. Environmental problems, however, have led to a demand for a reduction in or total abolition of the use of vinyl chloride-containing materials. Further, other conventional thermal transfer image-receiving sheets and thermal transfer sheets disadvantageously cannot provide satisfactory print density.

The adoption of a method wherein the amount of dyes added to a binder for holding dyes in the thermal transfer sheet is increased, a method wherein a large amount of a plasticizer is added to the receptive layer, or a method wherein thermal transfer is carried out at high energy or low speed, is considered effective for providing satisfactory print density.

Increasing the amount of dyes, however, causes migration of the dye to the backside of the thermal transfer sheet. This disadvantageously causes a lowering in print density with the elapse of time, contamination of the backside, and contamination of a thermal head which shortens the service life of the thermal head. Further, at the time of thermal transfer, fusing occurs between the thermal transfer sheet and the thermal transfer image-receiving sheet probably due to plasticization of the dye binder by the dye.

The addition of a large amount of a plasticizer to the receptive layer softens the resin constituting the receptive layer and thus can improve dyeability, but on the other hand, poses problems including that mere contact of the receptive layer with the dye layer at room temperature causes dyeing of the receptive layer, a problem called "smudge," i.e., unfavorable dyeing by waste heat generated in printing; fusing between the receptive layer and the dye binder in the thermal transfer sheet is likely to occur in a region from halftone region to high density region and, in this case, a large noisy sound is produced in the separation of the thermal transfer image-receiving sheet from the thermal transfer sheet at the time of printing, and, in some cases, the receptive layer is completely fused to the thermal transfer sheet, and, consequently, normal printing cannot be carried out, that is, abnormal transfer occurs.

Further, the addition of the plasticizer poses a problem of a change with the elapse of time, for example, that the formed image blurs with the elapse of time and the sensitivity in printing varies depending upon an environment in which the image-receiving sheet before the formation of an image is stored, making it impossible to provide prints having stable color tone. High-energy printing or low-speed printing is contrary to the demand in recent years, and, further, the thermal transfer at high energy causes fusing between the thermal transfer sheet and the thermal transfer image-receiving sheet at the time of thermal transfer and consequently causes abnormal transfer.

A method for solving the problem of the plasticizer is to adopt a multilayer structure in the receptive layer wherein a plasticizer-containing layer is provided as the lower layer (substrate side). In this case, however, the dyeability of the upper layer (surface layer) is so small that, in the case of direct printing, the dye cannot be diffused into the lower layer and, thus, the print density is low. Further, due to the multilayer structure, the production of the image-receiving sheet is complicated, and, thus, the production cost is disadvantageously high.

Accordingly, in a first aspect, an object of the present invention is to solve the above problems of the prior art and to provide a thermal transfer image-receiving sheet which has dyeability high enough to realize high-speed printing and low-energy printing, permits a protective layer to be thermally transferred onto the formed image, can avoid heat fusing between the thermal transfer image-receiving sheet and a thermal transfer sheet at the time of image formation, and has satisfactory separability from the thermal transfer sheet.

In general, what is important for effectively carrying out the formation of an image by thermal transfer is the construction of the thermal transfer sheet for feeding colorants, as well as the construction of the image-receiving sheet for receiving colorants for the formation of an image.

Regarding conventional image-receiving sheets, as described above, for example, Japanese Patent Laid-Open Nos. 169370/1982, 207250/1982, and 25793/1985 disclose resins for the receptive layer. Specifically, vinyl resins, such as polyvinyl chloride resins, polyvinyl butyral resins, acrylic resins, cellulosic resins, olefin resins, polystyrene resins, polyester resins, polycarbonate resins and the like are disclosed as resins for the formation of the receptive layer. Release agents usable in the image-receiving sheet include various silicone release agents, fluoro release agents, waxes, and surfactants.

In recent years, a method for image formation wherein, after image formation, a proper protective layer is provided according to purposes, has been mainly used from the viewpoints of improving storage stability of prints, such as lightfastness and chemical resistance, and providing added values of practicality, design, and security, such as the impartation of writing quality to the surface of prints and the formation of a hologram layer. For this reason, the image-receiving sheet should have satisfactory separability high enough to avoid heat fusing to the dye binder in the transfer sheet at the time of image formation. On the other hand, at the time of the transfer of a protective layer, the image formed face should have satisfactory adhesion to the protective layer. Thus, the image-receiving sheet should have contradictory properties.

Vinyl chloride-vinyl acetate copolymer resins have hitherto been extensively used as resins satisfying these properties. In recent years, however, environmental problems have led to a demand for a reduction in or total abolition of the use of vinyl chloride-containing materials. Also in this respect, the development of a novel resin for a receptive layer, which can satisfy both requirements, i.e., satisfactory separability from the thermal transfer sheet and good adhesion to the protective layer, has been demanded.

Accordingly, in a second aspect, an object of the present invention is to provide a thermal transfer image-receiving sheet, without use of any vinyl chloride resin, which can satisfy both requirements, i.e., satisfactory separability from the thermal transfer sheet at the time of image formation and good adhesion to the protective layer at the time of the transfer of a protective layer.

Thermal transfer recording materials, used with a thermal dye sublimation transfer method, comprising a thermal transfer sheet comprising a dye layer provided on a substrate sheet and a thermal transfer image-receiving sheet comprising a receptive layer provided on a substrate have hitherto been used. An increase in printing speed in thermal transfer printers in recent years, however, has posed a problem that conventional thermal transfer recording materials cannot provide satisfactory print density.

When the dye/resin (dye/binder) ratio in the dye layer of the thermal transfer sheet is increased for overcoming this problem, during the storage of the thermal transfer sheet in a rolled state, the dye is transferred onto the heat-resistant slip layer provided on the backside of the thermal transfer sheet. Upon rewinding of the thermal transfer sheet, the transferred dye is retransferred (kickbacked) onto other color dye layer or a transferable protective layer, and the thermal transfer of the contaminated layer onto the image-receiving sheet provides a hue different from a specified hue or causes the so-called "smudge."

Further, when the thermal transfer printer is regulated to apply high energy at the time of thermal transfer in the image formation, the dye layer is fused to the receptive layer, resulting in the so-called "abnormal transfer." The addition of a large amount of a release agent to the receptive layer for preventing the abnormal transfer lowers the print density.

Further, the thermal transfer sheet had the following problems. Specifically, it is said that, when the formed thermal transfer sheet is stored for a long period of time, the state of presence of dyes in the dye layer is changed, although this varies depending upon storage environment, and, consequently, the surface of the dye layer is brought to a dye-rich state. This change in the dye layer causes the dye to be easily transferred even at low energy. This poses a problem that printing using a thermal transfer sheet after storage for a long period of time after the production thereof is likely to cause a phenomenon wherein a higher density than desired is developed particularly in low density region, a phenomenon wherein the dye is disadvantageously transferred onto the image-receiving sheet by only the pressure applied by a platen at the time of printing, or a phenomenon wherein the dye is disadvantageously transferred by waste heat of the thermal head.

As described above, in order to cope with increased printing speed of the thermal transfer and to meet a demand for a higher level of properties of media, the regulation of the thermal transfer printer side and the modification of a thermal transfer recording material comprising a thermal transfer sheet and a thermal transfer image-receiving sheet have been made. These methods, however, have posed a problem of unsatisfactory printing density, contamination by kickback, or a change in print density during storage for a long period of time. Thus, prints having satisfactory quality could not have hitherto been produced.

Accordingly, in a third aspect, an object of the present invention is to provide a thermal transfer recording material which can cope with increased printing speed of the thermal transfer and can meet a demand for a higher level of properties of media and can yield high-quality prints.

DISCLOSURE OF THE INVENTION

First Invention

The first invention relates to a thermal transfer image-receiving sheet comprising: a substrate sheet; and a receptive layer provided on at least one side of the substrate sheet, said receptive layer comprising at least a combination of a cellulose ester resin (A) having a degree of acetylation of 10 to 30% with a cellulose ester resin (B) having a degree of acetylation of less than 6%, the total degree of acetylation of the cellulose ester resin (A) and the cellulose ester resin (B) being 8 to 14%, the content of hydroxyl groups in the cellulose ester resin (A) and the content of hydroxyl groups in the cellulose ester resin (B) each being not more than 6% by weight, the remaining hydroxyl groups having been esterified with an organic acid excluding acetic acid.

The organic acid is preferably propionic acid and/or butyric acid.

Preferably, the receptive layer further comprises a compatible thermoplastic resin.

Preferably, the receptive layer comprises at least one plasticizer selected from the group consisting of phthalic acid plasticizers, phosphate plasticizers, polycaprolactones, and polyester plasticizers and the content of the plasticizer is not more than 15% by weight based on the total weight of the plasticizer and the resins constituting the receptive layer.

Preferably, the receptive layer comprises at least one release agent.

Preferably, the release agent comprises at least a modified silicone oil and/or a cured product thereof, a fluorosurfactant, and/or a silicone surfactant.

Preferably, the silicone surfactant is a polyether-modified silicone.

Preferably, after the formation of an image on the thermal transfer image-receiving sheet in its image-receiving face, a protective layer is transferred onto the image formed face.

In a thermal transfer image-receiving sheet comprising a substrate sheet and a receptive layer provided on at least one side of the substrate sheet, the receptive layer comprises at least a combination of a cellulose ester resin (A) having a degree of acetylation of 10 to 30% with a cellulose ester resin (B) having a degree of acetylation of less than 6%, the total degree of acetylation of the cellulose ester resin (A) and the cellulose ester resin (B) is 8 to 14%, the content of hydroxyl groups in the cellulose ester resin (A) and the content of hydroxyl groups in the cellulose ester resin (B) each are not more than 6% by weight, and the remaining hydroxyl groups has been esterified with an organic acid excluding acetic acid. By virtue of the above construction, a thermal transfer image-receiving sheet can be provided which can form an image using a non-polyvinyl choride material with high dyeability by high-speed printing and low-energy printing, has excellent separability from a thermal transfer sheet, is free from blurring derived from plasticizers, and can yield a thermally transferred image having storage stability.

Further, after the formation of an image on the thermal transfer image-receiving sheet in its image-receiving face, the transfer of a protective layer onto the image formed face can provide prints which have good fastness or resistance properties such as high lightfastness.

Second Invention

The second invention relates to a thermal transfer image-receiving sheet comprising: a substrate sheet; and a dye-receptive layer provided on at least one side of the substrate sheet, said dye-receptive layer containing, at least in its outermost surface portion, at least one polyether-modified silicone selected from the group consisting of polyether-modified silicones represented by formulae (B1), (B2), and (B3), said polyether-modified silicones having a siloxane content of 25 to 65% by weight:

(B1)

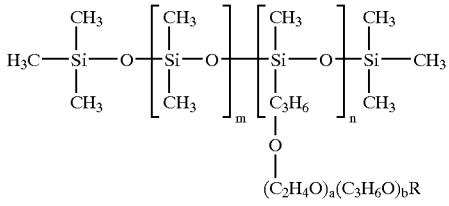

wherein polyether-modified silicones represented by formula (B1) are of grafting type, R represents H, an aryl group, or a straight-chain or branched alkyl group optionally substituted by a cycloalkyl group, m and n are each an integer of not more than 2000, and a and b are each an integer of 1 to 30;

(B2)

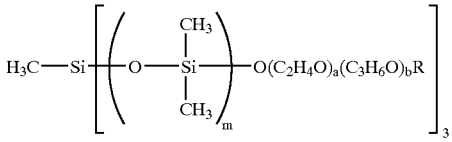

wherein polyether-modified silicones represented by formula (B2) are of end modification type, R represents H, an aryl group, or a straight-chain or branched alkyl group optionally substituted by a cycloalkyl group, m is an integer of not more than 2000, and a and b are each an integer of 1 to 30; and (B3)

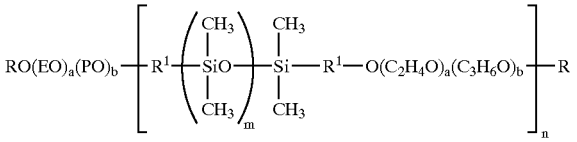

wherein polyether-modified silicones represented by formula (B3) are of main chain copolymerization type, R represents H, an aryl group, or a straight-chain or branched alkyl group optionally substituted by a cycloalkyl group, $R^1$ represents an aryl group or a straight-chain or branched alkyl group optionally substituted by a cycloalkyl group, m and n are each an integer of not more than 2000, and a and b are each an integer of 1 to 30.

According to a preferred embodiment of the present invention, the weight ratio of ethylene oxide (EO) to propylene oxide (PO), EO/PO, in the polyether-modified silicones is 35/65 to 65/35.

According to a further preferred embodiment of the present invention, the polyether-modified silicone is contained in an amount of not more than 10% by weight based on 100 parts by weight of a resin component constituting the dye-receptive layer.

In the present invention, the dye-receptive layer may further comprise an epoxy-modified silicone and/or a methylstyrene-modified silicone.

Preferably, in the present invention, the resin component constituting the dye-receptive layer is a thermoplastic resin selected from the group consisting of acrylic resin, styrene resin, acryl-styrene resin, acrylonitrile-styrene resin, polycarbonate resin, cellulose ester resin, and mixtures of said resins.

Further, according to the present invention, there is provided an image formed object produced by forming an image on an image-receiving face of the above thermal transfer image-receiving sheet and then transferring a protective layer onto the image formed face.

Third Invention

The third invention relates to a thermal transfer recording material comprising: a thermal transfer sheet comprising a substrate sheet and a dye layer provided on at least one side of the substrate sheet; and a thermal transfer image-receiving sheet comprising a substrate and a receptive layer provided on at least one side of the substrate, a dye contained in the dye layer in the thermal transfer sheet being transferable onto the receptive layer in the thermal transfer image-receiving sheet by putting the thermal transfer sheet and the thermal transfer image-receiving sheet on top of each other, so that the dye layer faces the receptive layer, and heating the assembly by heating means, said dye layer comprising at least dyes and a binder resin, said dyes including at least two or more dyes having an identical basic skeleton, said dyes having an identical basic skeleton including at least one combination of dyes which are different from each other in melting point by 10° C. or above, said receptive layer comprising a cellulose ester resin.

According to a preferred embodiment of the present invention, the dyes are yellow dyes having a basic skeleton selected from quinophthalone dyes represented by formula (C1) and dicyanostyryl dyes represented by formula (C2):

(C1)

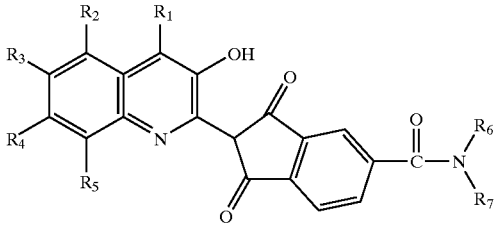

wherein $R_1$, $R_2$, $R_3$, $R_4$, and $R_5$ each independently represent a hydrogen atom, a halogen atom, a $C_1$ to $C_8$ alkyl group, a cycloalkyl group, an alkoxy group, an alkoxyalkyl group, an alkoxycarbonyl group, a thioalkoxy group, an alkylsulfonyl group, an amino group, a substituted or unsubstituted phenoxy group, or a substituted or unsubstituted thiophenoxy group, and $R_6$ and $R_7$ each independently represent a hydrogen atom, an alkyl group, an alkoxyalkyl group, a cycloalkyl group, an allyl group, an optionally substituted aryl group, an aralkyl group, a furfuryl group, a tetrahydrofurfuryl group, or a hydroxyalkyl group; and (C2)

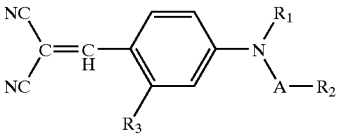

wherein $R_1$ represents an allyl group or an alkyl group, $R_2$ represents a substituted or unsubstituted alkyl group or an aryl group, A represents $—CH_2—$, $—CH_2CH_2—$, $—CH_2CH_2O—$, $—CH_2CH_2OCH_2—$, or $—CH_2CH_2OCH_2CH_2—$, and $R_3$ represents an alkyl group.

Further, according to a preferred embodiment of the present invention, the dyes are magenta dyes having a basic skeleton selected from imidazoleazo dyes represented by formula (C3) and anthraquinone dyes represented by formula (C4):

(C3)

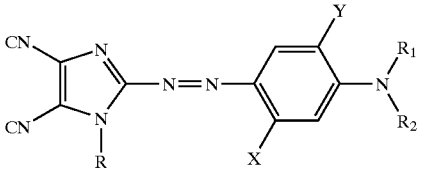

wherein R represents an alkyl group, an alkenyl group, an aryl group, a cyanoalkyl group, or a substituted or unsubstituted alkoxycarbonylalkyl group, $R_1$ and $R_2$ represent an alkenyl group, an aralkyl group, or a substituted or unsubstituted alkyl group, X represents a hydrogen atom, a methyl group, a methoxy group, a formylamino group, an alkylcarbonylamino group, an alkylsulfonylamino group, or an alkoxycarbonylamino group, and Y represents a hydrogen atom, a methyl group, a methoxy group, or a halogen atom; and (C4)

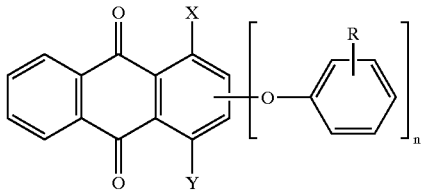

wherein R represents a hydrogen atom, a hydroxyl group, a substituted or unsubstituted alkyl group, or a substituted or unsubstituted alkoxy group, X and Y represent an amino group or a hydroxyl group, and n is 1 or 2.

According to a preferred embodiment of the present invention, the dyes are cyan dyes having a basic skeleton selected from indoaniline dyes represented by formula (C5) and anthraquinone dyes represented by formula (C6):

(C5)

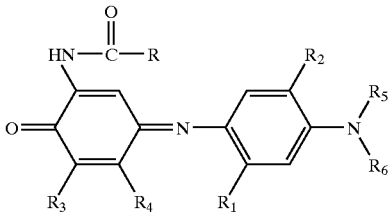

wherein $R_1$ represents a hydrogen atom; an alkyl group optionally substituted by a fluorine atom; an alkoxy group; an alkylamino group; an alkylcarbonylamino group optionally substituted by a fluorine atom; or a halogen atom; $R_2$ represents a hydrogen atom; an alkyl group optionally substituted by a fluorine atom; an alkoxy group; or a halogen atom, $R_3$ and $R_4$ represent a hydrogen atom; an alkyl group optionally substituted by a fluorine atom; an alkoxy group; or a halogen atom, and R, $R_5$, and $R_6$ represent a hydrogen atom, a $C_1$ to $C_6$ substituted or unsubstituted alkyl group, an aryl group, or an alkoxy group; and (C6)

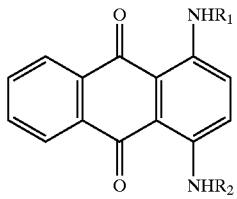

wherein $R_1$ and $R_2$ represent a substituted or unsubstituted alkyl group, a substituted or unsubstituted aryl group, a substituted or unsubstituted allyl group, or a substituted or unsubstituted aralkyl group.

Further, according to a preferred embodiment of the present invention, the thermal transfer sheet comprises a yellow dye layer, a magenta dye layer, and a cyan dye layer provided in a face serial manner on the substrate sheet, the yellow dye layer comprises at least the above yellow dyes, the magenta dye layer comprises at least the above magenta dyes, and the cyan dye layer comprises at least the above cyan dyes.

According to a preferred embodiment of the present invention, the binder resin contained in the dye layer is any one of polyvinyl acetal resin and polyvinyl butyral resin.

According to a preferred embodiment of the present invention, the thermal transfer sheet comprises the dye layer and a transferable protective layer provided in a face serial manner on the substrate sheet.

According to a preferred embodiment of the present invention, in the thermal transfer image-receiving sheet, the receptive layer contains a thermoplastic resin compatible with the cellulose ester resin.

According to a preferred embodiment of the present invention, in the thermal transfer image-receiving sheet, the receptive layer contains not more than 15% by weight of at least one plasticizer selected from phthalic acid plasticizers, phosphate plasticizers, polycaprolactones, and polyester plasticizers.

According to the present invention, by virtue of a predetermined relationship between the basic skeleton and the melting point in dyes contained in the dye layer, a kickback phenomenon can be prevented, and the dyes are stably present. Further, the cellulose ester resin constituting the receptive layer can realize high print density and can impart good resistance to prints.

BEST MODE FOR CARRYING OUT THE INVENTION

First Invention

Figure 1:
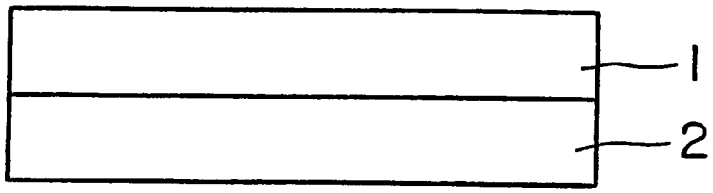
FIGS. 1 to 3 are cross-sectional views showing examples of the construction of a protective layer transfer sheet.

The thermal transfer image-receiving sheet according to the first invention will be described in detail.

(Substrate Sheet)

The substrate sheet in the thermal transfer image-receiving sheet functions to hold the receptive layer, and is heated at the time of thermal transfer. Therefore, the substrate sheet preferably has mechanical strength on a level such that, even in a heated state, the substrate sheet can be handled without any trouble.

Materials for such substrate sheets are not particularly limited, and examples of substrate sheets usable herein include: various types of paper, for example, capacitor paper, glassine paper, parchment paper, or paper having a high sizing degree, synthetic paper, such as polyolefin synthetic paper and polystyrene synthetic paper, cellulose fiber paper, such as wood free paper, art paper, coated paper, cast coated paper, wall paper, backing paper, synthetic resin- or emulsion-impregnated paper, synthetic rubber latex-impregnated paper, paper with synthetic resin internally added thereto, and paperboard; and films or sheets of various plastics, for example, polyester, polyacrylate, polycarbonate, polyurethane, polyimide, polyether imide, cellulose derivative, polyethylene, ethylene-vinyl acetate copolymer, polypropylene, polystyrene, acrylic resin, polyvinyl chloride, polyvinylidene chloride, polyvinyl alcohol, polyvinyl butyral, nylon, polyether ether ketone, polysulfone, polyether sulfone, tetrafluoroethylene, perfluoroalkyl vinyl ether, polyvinyl fluoride, tetrafluoroethylene-ethylene, tetrafluoroethylene-hexafluoropropylene, polychlorotrifluoroethylene, polyvinylidene fluoride and the like. Further, for example, white opaque films produced by adding a white pigment or a filler to these synthetic resins and forming films from the mixtures, or foamed sheets produced by foaming the resin may also be used without particular limitation.

A laminate of any combination of the above substrate sheets may also be used. Examples of representative laminates include a synthetic paper in the form of a laminate composed of a cellulose fiber paper and a synthetic paper and a synthetic paper in the form of a laminate composed of a cellulose fiber paper and a plastic film or sheet. These laminated synthetic papers may have a two-layer structure, or alternatively may have a structure of three or more layers, for example, comprising a synthetic paper and a plastic film laminated respectively onto both sides of a cellulose fiber paper which is useful for imparting hand or texture to the substrate. The lamination may be carried out, for example, by dry lamination, wet lamination, or extrusion without particular limitation.

A pressure-sensitive adhesive layer may be provided separably between a desired combination of substrate sheets constituting the laminate to form a substrate in a seal form. Further, in order to regulate the gloss of the image-receiving sheet, a receptive layer is formed on a layer having desired gloss, followed by transfer onto the substrate. A receptive layer may be provided separably on the substrate sheet so that the receptive layer after printing is transferred onto a desired support (a card or a support having a curved surface).

The thickness of the substrate sheet may be any desired one and is generally about 10 to 300 $\mu$m.

When the substrate sheet has poor adhesion to a layer formed on its surface, the surface of the substrate sheet is preferably subjected to various types of primer treatment or corona discharge treatment.

(Intermediate Layer)

An intermediate layer may be provided as a constituent element between the substrate sheet and the receptive layer provided on the substrate sheet. The intermediate layer refers to all layers provided between the substrate sheet and the receptive layer and may have a multilayer structure. Functions of the intermediate layer include solvent resistance imparting function, barrier property imparting function, adhesion imparting function, whiteness imparting function, opaqueness imparting function, and antistatic function. The function of the intermediate layer is not limited to these only, and all the conventional intermediate layers may be used.

In order to impart the solvent resistance and the barrier property, a water-soluble resin is preferably used. Water-soluble resins include cellulosic resins, particularly carboxymethylcellulose, polysaccharide resins such as starch, proteins particularly casein, gelatin, agar, vinyl resins, such as polyvinyl alcohol, ethylene-vinyl acetate copolymer, polyvinyl acetate, vinyl chloride-vinyl acetate copolymer, vinyl acetate-(meth)acryl copolymer, vinyl acetate-Veova copolymer, (meth)acrylic resin, styrene-(meth)acryl copolymer, and styrene resin, melamine resin, urea resin, benzoguanamine resin and other polyamide resins, polyester, and polyurethane. Here the water-soluble resin refers to a resin which, when added to a solvent composed mainly of water, is fully dissolved to prepare a solution (particle diameter: not more than 0.01 μm), forms a colloidal dispersion (particle diameter: 0.01 to 0.1 μm), forms an emulsion (particle diameter: 0.1 to 1 μm), or forms a slurry (particle diameter: not less than 1 μm).

In order to impart the adhesion, urethane resin and polyester resin are generally used although the type of the resin varies depending upon the type of the substrate sheet and the surface treatment of the substrate sheet. Further, the combined use of a thermoplastic resin having active hydrogen and a curing agent, such as an isocyanate compound, can provide good adhesion.

In order to impart whiteness, a brightening agent may be used. The brightening agent may be any conventional compound, and examples thereof include stilbene, distilbene, benzoxazole, styryl-oxazole, pyrene-oxazole, coumarin, aminocoumarin, imidazole, benzimidazole, pyrazoline, and distyryl-biphenyl brightening agents. The whiteness can be regulated by varying the type of the brightening agent and the amount of the brightening agent added.

The brightening agent may be added by any method. Specific examples of methods usable herein include a method wherein the brightening agent is dissolved in a solvent for a binder resin, such as water or an organic solvent, to prepare a solution which is then added, a method wherein the brightening agent is pulverized by means of a ball mill or a colloid mill to prepare a powder which is then added, a method wherein the brightening agent is dissolved in a high-boiling solvent to prepare a solution and the solution is then mixed with a hydrophilic colloid solution to prepare an oil-in-water type dispersion which is then added, and a method wherein the brightening agent is impregnated with a polymer latex and, in this state, is added.

Further, the addition of titanium oxide in the intermediate layer to conceal glare and lack of uniformity of the substrate sheet can advantageously further increase the degree of freedom in the selection of the substrate sheet. Two types of titanium oxide, i.e., rutile titanium oxide and anatase titanium oxide, are available. When the whiteness and the effect of the brightening agent are taken into consideration, however, the anatase titanium oxide, which absorbs ultraviolet region of shorter wavelengths than the rutile titanium oxide, is preferred.

When the binder resin in the intermediate layer is used with water and titanium oxide is less likely to be dispersed, titanium oxide having a hydrophilized surface may be used, or alternatively titanium oxide may be dispersed with the aid of a conventional dispersant such as a surfactant or ethylene glycol. The amount of titanium oxide added is preferably 100 to 400 parts by weight on a solid titanium oxide basis based on 100 parts by weight of the resin on a solid basis.

In order to impart antistatic function, proper conventional material, for example, conductive inorganic fillers or organic conductive agents such as polyanilinesulfonic acid may be selected and used according to the binder resin in the intermediate layer.

(Receptive Layer)

According to the present invention, in a thermal transfer image-receiving sheet comprising a substrate sheet and a receptive layer provided on at least one side of the substrate sheet, the receptive layer comprises at least a combination of a cellulose ester resin (A) having a degree of acetylation of 10 to 30% with a cellulose ester resin (B) having a degree of acetylation of less than 6%, the total degree of acetylation of the cellulose ester resin (A) and the cellulose ester resin (B) being 8 to 14%, the content of hydroxyl groups in the cellulose ester resin (A) and the content of hydroxyl groups in the cellulose ester resin (B) each being not more than 6% by weight, the remaining hydroxyl groups having been esterified with an organic acid excluding acetic acid.

The use of cellulose ester resins in the receptive layer is disclosed in Japanese Patent Laid-Open No. 296595/1992. However, the cellulose ester resin (A) having a degree of acetylation of 10 to 30% has low dyeability, and the use of a plasticizer in an amount of not less than 15% by weight, preferably not less than 20% by weight, is necessary for providing satisfactory dyeability. As described later, the addition of the plasticizer poses problems of abnormal transfer at the time of printing, blurring of formed images, and color development (smudge) of a contacted portion in the non-heating area at the time of thermal transfer and thus cannot be practically used.

The cellulose ester resin (B) having a degree of acetylation of less than 6% is dyeable. This resin, however, causes abnormal transfer. In particular, under high-speed printing conditions or low-energy printing conditions which have been required in recent years, the abnormal transfer is significant probably because the amount of instantaneously applied energy is large. The present inventors have found that, when the cellulose ester resins (A) and (B) are used in combination so that the total degree of acetylation of the cellulose ester resins is 8 to 14%, the occurrence of the abnormal transfer at the time of printing can be avoided while maintaining the dyeability provided by the cellulose ester resin (B).

When the receptive layer is formed of two or more resins according to the present invention in such a manner that the total degree of acetylation of the cellulose ester resins (A) and (B) is 8 to 14%, a protective layer can be adhered onto the receptive layer. On the other hand, when a cellulose ester resin (A) having a degree of acetylation of 8 to 14% or a cellulose ester resin (B) having a degree of acetylation of 8 to 14% is solely used, a protective layer is not adhered onto the receptive layer. Therefore, in this case, disadvantageously, the effect of improving the fastness or resistance properties by the protective layer cannot be attained, and various functions, for example, writing quality and holograms, cannot be imparted.

The degree of acetylation generally described in catalogs or the like refers to % by weight of acetyl groups. In the present invention, since a blend of at least two resins is used, the degree of acetylation refers to % by weight based on the whole resin component (excluding plasticizers and release agents).

Any conventional organic acid described, for example, in Kagaku Daijiten (Encyclopaedia Chimica) (edited by Encyclopaedia Chimica Edition Committee; Kyoritsu Shuppan Co., Ltd.) and Japanese Patent Laid-Open No. 296595/1992 may be esterified and used as the organic acid. However, propionic acid and/or butyric acid are preferred because they are on the market and thus are easily available. Cellulose acetate butyrate (CAB) prepared by converting butyric acid having high dyeability to an ester is particularly preferred.

Further, a thermoplastic resin may be blended in such an amount that the resin is compatible. Thermoplastic resins, which can be blended, include: cellulose ester resins having a degree of acetylation of more than 30%; cellulose ester resins using fatty acids other than acetic acid; vinyl resins such as polyacrylate resins, polystyrene resins, and polystyrene-acryl resins; various saturated or unsaturated polyester resins; polycarbonate resins; polyolefin resins; and polyamide resins such as urea resins, melamine resins, and benzoguanamine resins. The resin may be blended in an amount of 0 to 100 parts by weight based on 100 parts by weight in total of the cellulose ester resins. When the amount of the resin blended exceeds 100 parts by weight, the effect attained by the combination of the cellulose ester resin (A) with the cellulose ester resin (B) cannot be provided.

The receptive layer according to the present invention may contain at least one plasticizer selected from phthalic acid plasticizers, phosphate plasticizers, polycaprolactones, and polyester plasticizers. The content of the plasticizer is preferably not more than 15% by weight, more preferably not more than 12% by weight, based on the total weight of the plasticizer and the resins constituting the receptive layer. When the content of the plasticizer exceeds 15% by weight, abnormal transfer disadvantageously occurs at the time of printing. When the content of the plasticizer is in the range of 12 to 15% by weight, blurring of formed images and color development (smudge) of a contacted portion in the non-heating area at the time of thermal transfer do not substantially occur. When the content of the plasticizer is not more than 12% by weight, neither blurring of formed images nor smudge occurs.

In the present invention, existing release agents may be used as the release agent. In particular, three types of release agents, i.e., fluorosurfactants, silicone surfactants, silicone oils and/or cured products thereof, are preferred. Fluorosurfactants include Fluorad FC-430 and Fluorad FC-431, manufactured by 3M.

Polyether-modified silicones are particularly preferred as the silicone surfactant, and grafting type polyether-modified silicones (formula A1), wherein ethylene oxide and/or propylene oxide copolymer have been grafted onto a part of methyl groups in dimethylsiloxane, end modification type polyether-modified silicones (formula A2), and main chain copolymerization type polyether-modified silicones (formula A3) may be used solely or as a mixture of two or more.

(A1)

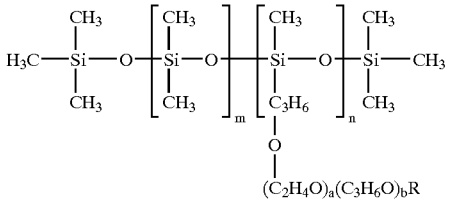

wherein R represents H, an aryl group, or a straight-chain or branched alkyl group optionally substituted by a cycloalkyl group, m and n are each an integer of not more than 2000, and a and b are each an integer of not more than 30;

(A2)

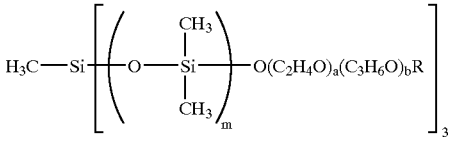

wherein R represents H, an aryl group, or a straight-chain or branched alkyl group optionally substituted by a cycloalkyl group, m is an integer of not more than 2000, and a and b are each an integer of not more than 30; and (A3)

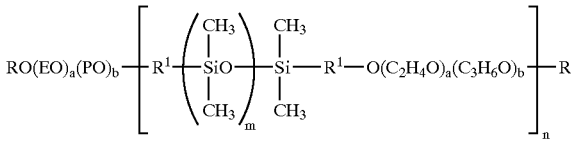

wherein R represents H, an aryl group, or a straight-chain or branched alkyl group optionally substituted by a cycloalkyl group, m and n are each an integer of not more than 2000, and a and b are each an integer of not more than 30.

Further, various modified silicone oils and cured products thereof as described in "Sirikohn Handobukku (Silicone Handbook)," published by The Nikkan Kogyo Shimbun, Ltd. may be used as the silicone oil. When a protective layer is transferred and adhered onto the receptive layer, the use of the fluorosurfactant or the uncured silicone oil is preferred from the viewpoint of the adhesion of the protective layer to the receptive layer. These types of release agents may be used solely or in a proper combination of two or more types.

In the present invention, after the formation of an image on the surface of the receptive layer in the image-receiving sheet, a protective layer may be transferred onto the image formed face. The transfer of the protective layer can improve lightfastness of the prints and can improve durability such as resistant to sebum.

(Backside Layer)

A backside layer may be provided on the backside of the thermal transfer image-receiving sheet, for example, from the viewpoints of improving the carriability of sheets in a printer, preventing curling, and imparting antistatic properties. In order to improve the carriability, the addition of a suitable amount of an organic or inorganic filler to the binder resin or the use of a highly lubricious resin, such as a polyolefin resin or a cellulose resin, is preferred.

In order to impart an antistatic function, electrically conductive resins or fillers such as acrylic resin, and various antistatic agents, such as fatty esters, sulfuric esters, phosphoric esters, amides, quaternary ammonium salts, betaines, amino acids, or ethylene oxide adducts may be added. Alternatively, an antistatic layer may be provided as an uppermost layer on the backside layer or may be provided between the backside layer and the substrate.

The amount of the antistatic agent used varies depending upon the layer, to which the antistatic agent is added, and the type of the antistatic agent. In any case, the surface electric resistance value of the thermal transfer image-receiving sheet is preferably not more than $10^{13}\Omega/cm^2$. When the surface electric resistance value of the thermal transfer image-receiving sheet is more than $10^{13}\Omega/cm^2$, the thermal transfer image-receiving sheets stick to each other through electrostatic adhesion. This is causative of sheet feed troubles. The amount of the antistatic agent used is preferably 0.01 to 3.0 $g/m^2$. When the amount of the antistatic agent used is less than 0.01 $g/m^2$, the antistatic effect is unsatisfactory. On the other hand, the use of the antistatic agent in an amount of more than 3.0 $g/m^2$ is cost ineffective. Further, in this case, a problem of sticking or the like sometimes occurs.

The protective layer transfer sheet used in the present invention comprises a substrate sheet and a thermally transferable protective layer provided on the substrate sheet. The thermally transferable protective layer may have a single-layer structure or alternatively may be in the form of a laminate of a plurality of layers. For example, a release layer may be provided between the protective layer and the substrate sheet so that the protective layer can be easily separated from the substrate sheet.

Figure 2:
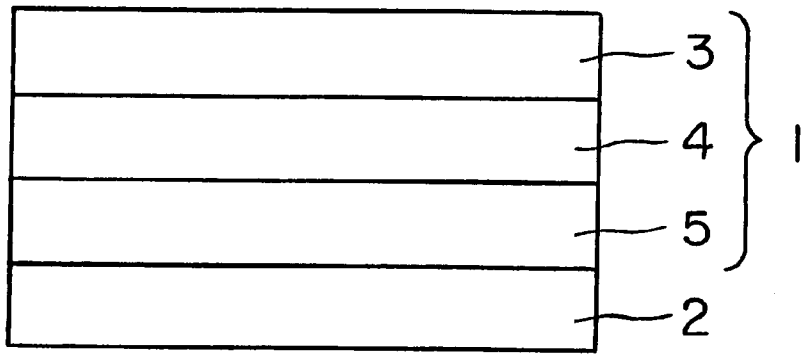
Figure 3:
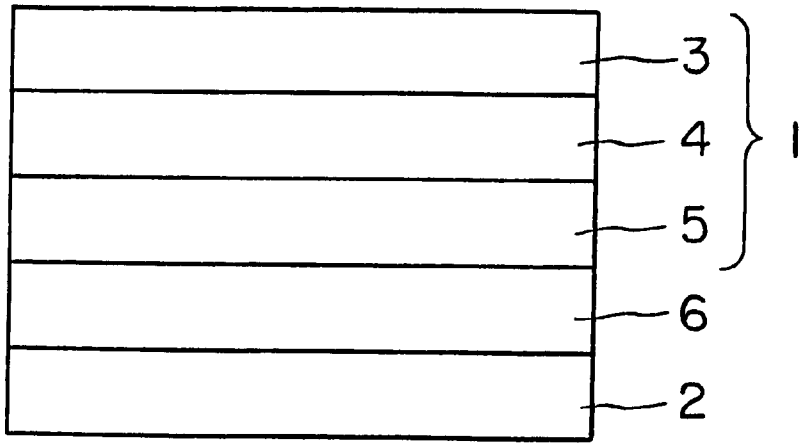

Examples of the construction of the protective layer are shown in FIGS. 1 to 3. In these drawings, the denotation of reference numerals is as follows.

1: Protective layer

2: Substrate sheet

3: Adhesive layer

4: Function layer

5: Peel layer

6: Release layer

The layers 3 to 5 may be constituted by a plurality of layers. Alternatively, the layer 4 or the layer 3 and the layer 5 may serve also as a function layer such as a security layer, a hologram layer, or a barrier layer. Thus, various conventional constructions may be used. The thermally transferable protective layer may be formed of various conventional resins commonly used as a resin for the formation of a protective layer. Examples of resins for the formation of a protective layer include thermoplastic resins, for example, polyvinyl homopolymer and copolymer resins, such as polyester resins, polycarbonate resins, polyacrylic esters, polystyrene, polyacrylstyrene, polyacrylonitrile-styrene, polyvinylacetoacetal, polyvinylbutyral, polyvinyl chloride, and polyvinyl chloride-vinyl acetate, polyurethane resins, acrylated urethane resins, epoxy resins, phenoxy resins, and silicone modification products of these resins. Crosslinkable resins usable herein include: ionizing radiation-crosslinkable resins; resins, which are heat crosslinkable with a crosslinking agent, such as isocyanate compounds or chelate compounds of the above thermoplastic resins; and mixtures of these resins. If necessary, ultraviolet screening resins, ultraviolet absorbers, and electrically conductive resins, electrically conductive fillers, organic fillers and/or inorganic fillers may be properly added.

The protective layer containing a crosslinked resin, such as an ionizing radiation-crosslinked resin or a heat-crosslinked resin, is excellent particularly in plasticizer resistance and scratch resistance. The ionizing radiation-crosslinkable resin may be any conventional one. For example, a radically polymerizable polymer or oligomer may be crosslinked by ionizing radition irradiation, and, if necessary, a photopolymerization initiator may be added followed by polymerization crosslinking by electron beam or ultraviolet light irradiation. The ionizing radiation-crosslinked resin is generally provided in the peel layer and may also be used in the release layer and the adhesive layer in the protective layer transfer sheet.

The protective layer containing an ultraviolet screening resin or an ultraviolet absorber functions mainly to impart lightfastness to prints. For example, the ultraviolet screening resin may be a resin produced by chemically bonding a reactive ultraviolet absorber to the thermoplastic resin or the ionizing radiation-curable resin. More specifically, resins produced by introducing a reactive group, such as an addition-polymerizable double bond, for example, a vinyl group, an acryloyl group, or a methacryloyl group, an alcoholic hydroxyl group, an amino group, a carboxyl group, an epoxy group, or an isocyanate group, into a conventional non-reactive organic ultraviolet absorber, such as salicylate, phenylacrylate, benzophenone, benzotriazole, cumarine, triazine, or nickel chelate ultraviolet absorber, may be mentioned as examples of such resins.

The ultraviolet absorber may be a conventional non-reactive organic ultraviolet absorber, and examples thereof include salicylate, phenylacrylate, benzophenone, benzotriazole, cumarine, triazine, and nickel chelate ultraviolet absorbers.

The ultraviolet screening resin and the ultraviolet absorber may also be added to the release layer and the adhesive layer in the protective layer transfer sheet.

Specific examples of organic fillers and/or inorganic fillers include, but are not particularly limited to, polyethylene wax, bisamides, nylon, acrylic resin, crosslinked polystyrene, silicone resin, silicone rubber, talc, calcium carbonate, titanium oxide, and finely divided silica powder, such as microsilica and colloidal silica. Preferably, the organic filler and inorganic filler are highly lubricious and have a particle diameter of not more than 10 $\mu$m, preferably 0.1 to 3 $\mu$m. The amount of the filler added is in the range of 0 to 100 parts by weight based on 100 parts by weight of the resin component so that, after the transfer of the protective layer, the transparency can be maintained.

The thermally transferable protective layer may be formed by adding optional additives, such as the ultraviolet absorber, the organic filler and/or the inorganic filler, to the resin for the formation of a protective layer, dissolving or dispersing the mixture in a suitable solvent to prepare an ink for the formation of a thermally transferable protective layer, coating the ink onto the substrate sheet, for example, by gravure printing, screen printing, or reverse coating using a gravure plate, and drying the coating.

In this case, the coverage of the whole layer to be transferred in the protective layer transfer sheet used in the present invention is about 3 to 30 $g/m^2$, preferably 5 to 20 $g/m^2$.

In the protective layer transfer sheet used in the present invention, an adhesive layer may be provided on the surface of the thermally transferable protective layer to improve transferability and adhesion onto prints as an object. The adhesive layer may be formed of any conventional pressure-sensitive adhesive or heat-sensitive adhesive. Preferably, the adhesive layer is formed of a thermoplastic resin having a glass transition temperature (Tg) of 50° C. to 80° C. For example, a resin having a suitable glass transition temperature is preferably selected from resins having good heat adhesion, such as polyester resins, vinyl chloride-vinyl acetate copolymer resins, acrylic resins, ultraviolet absorber resins, butyral resins, epoxy resins, polyamide resins, and vinyl chloride resins. In particular, the adhesive layer preferably contains at least one of polyester resins, vinyl chloride-vinyl acetate copolymer resins, acrylic resins, ultraviolet absorber resins, butyral resins, and epoxy resins. In this case, preferably, the above resins have a low molecular weight from the viewpoint of adhesion or when the adhesive layer is formed as a pattern by heating means, such as a thermal head, onto a part, rather than the whole surface, of the thermally transferable protective layer.

The ultraviolet absorber resin may be a resin produced by chemically bonding a reactive ultraviolet absorber to a thermoplastic resin or an ionizing radiation-curable resin. More specifically, resins produced by introducing a reactive group, such as an addition-polymerizable double bond, for example, a vinyl group, an acryloyl group, or a methacryloyl group, an alcoholic hydroxyl group, an amino group, a carboxyl group, an epoxy group, or an isocyanate group, into a conventional non-reactive organic ultraviolet absorber, such as salicylate, phenylacrylate, benzophenone, benzotriazole, cumarine, triazine, or nickel chelate ultraviolet absorber, may be mentioned as examples of such resins.

The adhesive layer may be formed by adding optional additives, such as inorganic or organic fillers, to the resin for the formation of an adhesive layer to prepare a coating liquid, coating the coating liquid, and drying the coating. The coverage of the adhesive layer is preferably about 0.5 to 10 $g/m^2$.

Second Invention

The thermal transfer image-receiving sheet according to the second invention comprises: a substrate sheet; and a dye-receptive layer provided on at least one side of the substrate sheet, said dye-receptive layer containing, at least in its outermost surface portion, at least one polyether-modified silicone selected from the group consisting of polyether-modified silicones represented by formulae (B1), (B2), and (B3), said polyether-modified silicones having a siloxane content of 25 to 65% by weight.

The construction of the present invention will be described in detail.

(Substrate Sheet)

The material for the substrate sheet is not particularly limited, and a conventional material may be properly used according to applications.

The substrate sheet functions to hold the receptive layer, and is heated at the time of thermal transfer. Therefore, the substrate sheet preferably has mechanical strength on a level such that, even in a heated state, the substrate sheet can be handled without any trouble.

Materials for such substrate sheets are not particularly limited, and examples of substrate sheets usable herein include: various types of paper, for example, capacitor paper, glassine paper, parchment paper, or paper having a high sizing degree, synthetic paper, such as polyolefin synthetic paper and polystyrene synthetic paper, cellulose fiber paper, such as wood free paper, art paper, coated paper, cast coated paper, wall paper, backing paper, synthetic resin- or emulsion-impregnated paper, synthetic rubber latex-impregnated paper, paper with synthetic resin internally added thereto, and paperboard; and films or sheets of various plastics, for example, polyester, polyacrylate, polycarbonate, polyurethane, polyimide, polyether imide, cellulose derivative, polyethylene, ethylene-vinyl acetate copolymer, polypropylene, polystyrene, acrylic resin, polyvinyl chloride, polyvinylidene chloride, polyvinyl alcohol, polyvinyl butyral, nylon, polyether ether ketone, polysulfone, polyether sulfone, tetrafluoroethylene-perfluoroalkyl vinyl ether, polyvinyl fluoride, tetrafluoroethylene-ethylene, tetrafluoroethylene-hexafluoropropylene, polychlorotrifluoroethylene, polyvinylidene fluoride and the like. Further, for example, white opaque films produced by adding a white pigment or a filler to these synthetic resins and forming films from the mixtures, or foamed sheets produced by foaming the resin may also be used without particular limitation.

A laminate of any combination of the above substrate sheets may also be used. Examples of representative laminates include a synthetic paper in the form of a laminate composed of a cellulose fiber paper and a synthetic paper and a synthetic paper in the form of a laminate composed of a cellulose fiber paper and a plastic film or sheet. These laminated synthetic papers may have a two-layer structure, or alternatively may have a structure of three or more layers, for example, comprising a synthetic paper and a plastic film laminated respectively onto both sides of a cellulose fiber paper which is useful for imparting hand or texture to the substrate. The lamination may be carried out, for example, by dry lamination, wet lamination, or extrusion without particular limitation.

A pressure-sensitive adhesive layer may be provided separably between a desired combination of substrate sheets constituting the laminate to form a substrate in a seal form. Further, in order to regulate the gloss of the image-receiving sheet, a receptive layer is formed on a layer having desired gloss, followed by transfer onto the substrate. A receptive layer may be provided separably on the substrate sheet so that the receptive layer after printing is transferred onto a desired support (a card or a support having a curved surface).

The thickness of the substrate sheet may be any desired one and is generally about 10 to 300 $\mu$m.

When the substrate sheet has poor adhesion to a layer formed on its surface, the surface of the substrate sheet is preferably subjected to various types of primer treatment or corona discharge treatment.

(Dye-receptive Layer)

The dye-receptive layer according to the present invention contains, at least in its outermost surface portion, a polyether-modified silicone selected from the group consisting of polyether-modified silicones represented by formulae (B1), (B2), and (B3) and mixtures of two or more of these polyether-modified silicones. In this case, the content of siloxane in the polyether-modified silicone should be 25 to 65% by weight.

When the content of siloxane in the polyether-modified silicone is less than 25% by weight or more than 65% by weight, problems disadvantageously occur including that the contemplated satisfactory separability cannot be provided, the adhesion of the protective layer is significantly deteriorated, or the foaming of the composition for the receptive layer is significant resulting in deteriorated processability.

Further, the present inventor has found that, in the polyether-modified silicone, the copolymerization of both ethylene oxide and propylene oxide is important for attaining the contemplated effect and the presence of only any one of ethylene oxide and propylene oxide cannot provide good separability. In this case, according to the present invention, the weight ratio of ethylene oxide (EO) to propylene oxide (PO), EO/PO, in the polyether-modified silicones is particularly preferably 35/65 to 65/35. When the ratio of EO to PO is outside the above-defined range, desired releasability is less likely to be provided. For this reason, preferably, these components have been copolymerized in a good balance in the above-defined EO/PO range.

Conventional thermoplastic resins may be used either solely or as a blend of two or more as the resin for constituting the dye-receptive layer usable in the present invention. In particular, the resin is preferably selected from (meth)acrylic ester resins, styrene resins, copolymer vinyl resins, such as acryl-styrene resins and acrylonitrile-styrene resins, polycarbonate resins, cellulose ester resins and the like. Further, a copolymer of styrene with a (meth)acrylic ester and/or acrylonitrile, and cellulose esters are preferred. Conventional acrylic acid, methacrylic acid, acrylic ester, and methacrylic ester monomers may be used as (meth) acrylic ester/acryl. In this case, however, a homopolymer of methyl methacrylate and a copolymer consisting of methyl methacrylate and styrene is unfavorable because of low dyeability.

The amount of the polyether-modified silicone used varies depending upon the type of the polyether-modified silicone. Preferably, however, the amount of the polyether-modified silicone used is not more than 10 parts by weight based on 100 parts by weight of the resin for the receptive layer and is a smallest possible amount that the contemplated properties of the silicone can be satisfactorily provided. The addition of the polyether-modified silicone in an amount exceeding 10 parts by weight is likely to cause a deterioration in separability or a deterioration in adhesion of the receptive layer to the protective layer. When the polyether-modified silicone has an HLB value of not less than 9, the foaming of a coating liquid for the receptive layer can be reduced, contributing to improved processability.

In the present invention, "the dye-receptive layer contains, at least in its outermost surface portion, the polyether-modified silicone" means both the case where the polyether-modified silicone component is locally present on the surface portion of the dye-receptive layer, and the case where a layer of the polyether-modified silicone component is formed on the surface of the dye-receptive layer.

Further, in the present invention, other additional components may also be added as components of the dye-receptive layer. For example, if necessary, epoxy-modified silicones and methylstyrene-modified silicones may be properly added. In these epoxy-modified silicones and methylstyrene-modified silicones usable in the present invention, the silicone, either in part or in whole, has been modified. In the case of the partially modified silicone, the other portion may be constituted by dimethylsilicone or alkyl-modified silicone. A silicone modified both with epoxy and with methylstyrene may also be used. The modified silicones may be added solely or in a proper combination of a plurality of silicones different from each other in the degree of modification and the type of modification. The amount of the silicone added is preferably in the range of 0 to 20 parts by weight, more preferably 0 to 10 parts by weight, based on 100 parts by weight of the resin. When the silicone is added, crosslinking of the silicone deteriorates the adhesion of the receptive layer to the protective layer. Therefore, when a modified silicone having a functional group is used, preferably, a functional group reactive with the functional group in the modified silicone is not added simultaneously with the addition of the modified silicone.

The receptive layer according to the present invention may contain at least one plasticizer selected from the group consisting of phthalic acid plasticizers, phosphate plasticizers, polycaprolactones, and polyester plasticizers. In this case, the content of the plasticizer is preferably not more than 15% by weight, more preferably not more than 10% by weight, based on the total weight of the plasticizer and the resins constituting the receptive layer. When the content of the plasticizer exceeds 15% by weight, abnormal transfer is likely to occur at the time of printing. When the content of the plasticizer is in the range of 10 to 15% by weight, blurring of formed images and color development (smudge) of a contacted portion in the non-heating area at the time of thermal transfer do not substantially occur. When the content of the plasticizer is not more than 10% by weight, neither blurring of formed images nor smudge occurs.

In the present invention, after the formation of an image on the image-receiving face in the receptive layer, a protective layer may be transferred onto the image formed face. The transfer of the protective layer can improve lightfastness of the prints and can improve durability such as resistant to sebum.

(Intermediate Layer)

An intermediate layer may be provided as a constituent element between the substrate and the receptive layer provided on the substrate sheet. The intermediate layer refers to all layers provided between the substrate sheet and the receptive layer and may have a multilayer structure. Functions of the intermediate layer include solvent resistance imparting function, barrier property imparting function, adhesion imparting function, whiteness imparting function, opaqueness imparting function, and antistatic function. The function of the intermediate layer is not limited to these only, and all the conventional intermediate layers may be used.

In order to impart the solvent resistance and the barrier property, a water-soluble resin is preferably used. Water-soluble resins include cellulosic resins, particularly carboxymethylcellulose, polysaccharide resins such as starch, proteins particularly casein, gelatin, agar, vinyl resins, such as polyvinyl alcohol, ethylene-vinyl acetate copolymer, polyvinyl acetate, vinyl chloride-vinyl acetate copolymer, vinyl acetate-(meth)acryl copolymer, vinyl acetate-Veova copolymer, (meth)acrylic resin, styrene-(meth)acryl copolymer, and styrene resin, melamine resin, urea resin, benzoguanamine resin and other polyamide resins, polyester, and polyurethane. Here the water-soluble resin refers to a resin which, when added to a solvent composed mainly of water, is fully dissolved to prepare a solution (particle diameter: not more than 0.01 $\mu$m), forms a colloidal dispersion (particle diameter: 0.01 to 0.1 $\mu$m), forms an emulsion (particle diameter: 0.1 to 1 $\mu$m), or forms a slurry (particle diameter: not less than 1 $\mu$m).

Among these water-soluble resins, resins, which are of course less likely to be dissolved and, in addition, are less likely to be swollen in general-purpose solvents, for example, hexane, cyclohexane, acetone, methyl ethyl ketone, xylene, ethyl acetate, butyl acetate, toluene, and alcohols, such as methanol, ethanol, and IPA, are particularly preferred. In this sense, resins fully dissolved in a solvent composed mainly of water are most preferred. In particular, polyvinyl alcohol resins and water-soluble polyester resins are mentioned as such resins.

In order to impart the adhesion, urethane resin and polyolefin resin are generally used although the type of the resin varies depending upon the type of the substrate sheet and the surface treatment of the substrate sheet. Further, the combined use of a thermoplastic resin having active hydrogen and a curing agent, such as an isocyanate compound, can provide good adhesion.

In order to impart whiteness, a brightening agent may be used. The brightening agent may be any conventional compound, and examples thereof include stilbene, distilbene, benzoxazole, styryl-oxazole, pyrene-oxazole, coumarin, aminocoumarin, imidazole, benzimidazole, pyrazoline, and distyryl-biphenyl brightening agents. The whiteness can be regulated by varying the type of the brightening agent and the amount of the brightening agent added.

The brightening agent may be added by any method. Specific examples of methods usable herein include a method wherein the brightening agent is dissolved in water to prepare a solution which is then added, a method wherein the brightening agent is pulverized by means of a ball mill or a colloid mill to prepare a powder which is then added, a method wherein the brightening agent is dissolved in a high-boiling solvent to prepare a solution and the solution is then mixed with a hydrophilic colloid solution to prepare an oil-in-water type dispersion which is then added, and a method wherein the brightening agent is impregnated with a polymer latex and, in this state, is added.

Further, the addition of titanium oxide in the intermediate layer to conceal glare and lack of uniformity of the substrate sheet can advantageously further increase the degree of freedom in the selection of the substrate sheet. Two types of titanium oxide, i.e., rutile titanium oxide and anatase titanium oxide, are available. When the whiteness and the effect of the brightening agent are taken into consideration, however, the anatase titanium oxide, which absorbs ultraviolet region of shorter wavelengths than the rutile titanium oxide, is preferred. When the binder resin in the intermediate layer is used with water and, further, titanium oxide is less likely to be dispersed, titanium oxide having a hydrophilized surface may be used, or alternatively titanium oxide may be dispersed with the aid of a conventional dispersant such as a surfactant or ethylene glycol. The amount of titanium oxide added is preferably 10 to 400 parts by weight on a solid titanium oxide basis based on 100 parts by weight of the resin on a solid basis.

In order to impart antistatic function, proper conventional material, for example, conductive inorganic fillers or organic conductive agents such as polyanilinesulfonic acid may be selected and used according to the binder resin in the intermediate layer.

(Backside Layer)

A backside layer may be provided on the backside of the thermal transfer image-receiving sheet, for example, from the viewpoints of improving the carriability of sheets in a printer, preventing curling, and imparting antistatic properties. In order to improve the carriability, the addition of a suitable amount of an organic or inorganic filler to the binder resin or the use of a highly lubricious resin, such as a polyolefin resin or a cellulose resin, is preferred.

In order to impart an antistatic function, electrically conductive resins or fillers such as acrylic resin, and various antistatic agents, such as fatty esters, sulfuric esters, phosphoric esters, amides, quaternary ammonium salts, betaines, amino acids, or ethylene oxide adducts may be added. Alternatively, an antistatic layer may be provided on the backside or may be provided between the backside layer and the substrate.

The amount of the antistatic agent used varies depending upon the layer, to which the antistatic agent is added, and the type of the antistatic agent. In any case, the surface electric resistance value of the thermal transfer image-receiving sheet is preferably not more than $10^{13}\Omega/cm^2$. When the surface electric resistance value of the thermal transfer image-receiving sheet is more than $10^{13}\Omega/cm^2$, the thermal transfer image-receiving sheets stick to each other through electrostatic adhesion. This is causative of sheet feed troubles. The amount of the antistatic agent used is preferably 0.01 to 3.0 $g/m^2$. When the amount of the antistatic agent used is less than 0.01 $g/m^2$, the antistatic effect is unsatisfactory. On the other hand, the use of the antistatic agent in an amount of more than 3.0 $g/m^2$ is cost ineffective. Further, in this case, a problem of sticking or the like sometimes occurs.

Third Invention

Embodiments of the third invention will be described with reference to the accompanying drawings.

Figure 4A:
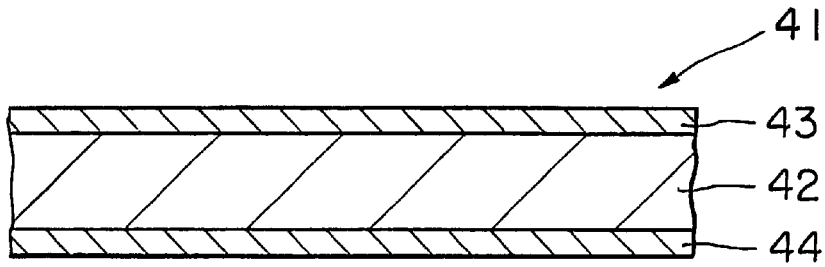
FIG. 4A is a schematic cross-sectional view showing an embodiment of a thermal transfer sheet constituting the thermal transfer recording material according to the present invention and FIG. 4B a schematic cross-sectional view showing an embodiment of a thermal transfer image-receiving sheet constituting the thermal transfer recording material according to the present invention.
Figure 4B:
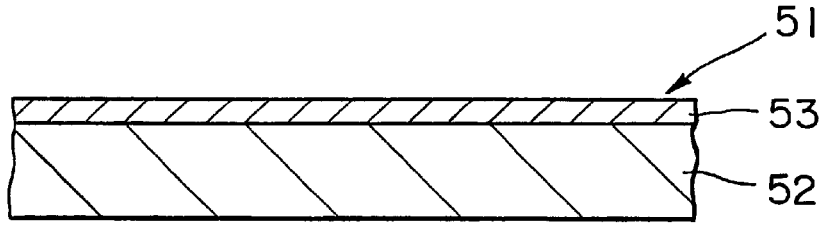

FIGS. 4A and 4B are schematic cross-sectional views showing an embodiment of the thermal transfer recording material according to the present invention. In FIGS. 4A and 4B, the thermal transfer recording material according to the present invention comprises: a thermal transfer sheet 41 comprising a substrate sheet 42, a dye layer 43 provided on one side of the substrate sheet 42, and a heat-resistant slip layer 44 provided on the other side of the substrate sheet 42; and a thermal transfer image-receiving sheet 51 comprising a substrate 52 and a receptive layer 53 provided on one side of the substrate 52.

The substrate sheet 42 constituting the thermal transfer sheet 41 may be any substrate sheet commonly used in the conventional thermal transfer sheet. Specific examples of preferred substrate sheets include: tissue papers, such as glassine paper, capacitor paper, and paraffin paper; stretched or unstretched films of various plastics, for example, highly heat-resistant polyesters, such as polyethylene terephthalate, polyethylene naphthalate, polybutylene terephthalate, polyphenylene sulfide, polyether ketone, and polyether sulfone, polypropylene, fluororesin, polycarbonate, cellulose acetate, polyethylene derivatives, polyvinyl chloride, polyvinylidene chloride, polystyrene, polyamide, polyimide, polymethylpentene, and ionomers; and laminates of the above materials. The thickness of the substrate sheet 42 may be properly selected depending upon materials for the substrate sheet so that the substrate sheet has proper strength, heat resistance and other properties. In general, however, the thickness is preferably about 1 to 100 $\mu$m.

The dye layer 3 constituting the thermal transfer sheet 41 is a thermally sublimable colorant layer comprising at least dyes and a binder resin. The dyes used include at least two or more dyes having an identical basic skeleton. The dyes having an identical basic skeleton include at least one combination of dyes which are different from each other in melting point by 10° C. or above, preferably by 10 to 90° C., more preferably by 10 to 70° C. The use of dyes having a predetermined relationship with respect to the basic skeleton and the melting point can prevent a kickback phenomenon and can stabilize the state of presence of the dyes. When the difference in melting point between the dyes exceeds 90° C., disadvantageously, the dyes are not easy to handle as dyes which are thermally transferred by thermal energy, that is, the transferability is lowered.

Specific examples of dyes usable herein include yellow dyes having a basic skeleton selected from quinophthalone dyes represented by formula (C1) and dicyanostyryl dyes represented by formula (C2):

(C1)

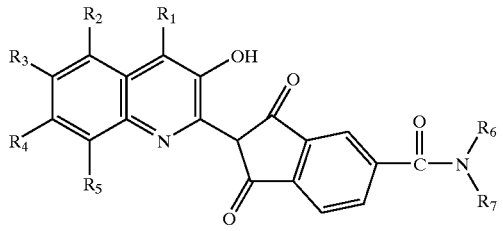

wherein $R_1$, $R_2$, $R_3$, $R_4$, and $R_5$ each independently represent a hydrogen atom, a halogen atom, a $C_1$ to $C_8$ alkyl group, a cycloalkyl group, an alkoxy group, an alkoxyalkyl group, an alkoxycarbonyl group, a thioalkoxy group, an alkylsulfonyl group, an amino group, a substituted or unsubstituted phenoxy group, or a substituted or unsubstituted thiophenoxy group, and $R_6$ and $R_7$ each independently represent a hydrogen atom, an alkyl group, an alkoxyalkyl group, a cycloalkyl group, an allyl group, an optionally substituted aryl group, an aralkyl group, a furfuryl group, a tetrahydrofurfuryl group, or a hydroxyalkyl group; and (C2)

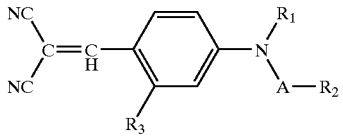

wherein $R_1$ represents an allyl group or an alkyl group, $R_2$ represents a substituted or unsubstituted alkyl group or an aryl group, A represents $—CH_2—$, $—CH_2CH_2—$, $—CH_2CH_2O—$, $—CH_2CH_2OCH_2—$, or $—CH_2CH_2OCH_2CH_2—$, and $R_3$ represents an alkyl group.

Specific examples of dyes usable herein include magenta dyes having a basic skeleton selected from imidazoleazo dyes represented by formula (C3) and anthraquinone dyes represented by formula (C4):

(C3)

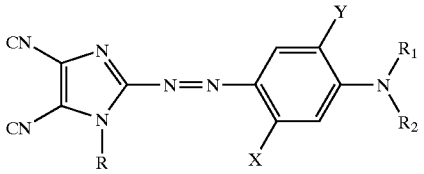

wherein R represents an alkyl group, an alkenyl group, an aryl group, a cyanoalkyl group, or a substituted or unsubstituted alkoxycarbonylalkyl group, $R_1$ and $R_2$ represent an alkenyl group, an aralkyl group, or a substituted or unsubstituted alkyl group, X represents a hydrogen atom, a methyl group, a methoxy group, a formylamino group, an alkylcarbonylamino group, an alkylsulfonylamino group, or an alkoxycarbonylamino group, and Y represents a hydrogen atom, a methyl group, a methoxy group, or a halogen atom; and (C4)

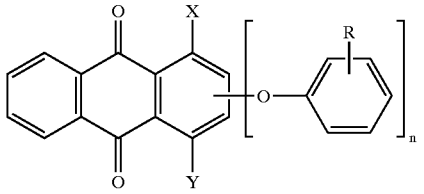

wherein R represents a hydrogen atom, a hydroxyl group, a substituted or unsubstituted alkyl group, or a substituted or unsubstituted alkoxy group, X and Y represent an amino group or a hydroxyl group, and n is 1 or 2.

Specific examples of dyes usable herein include cyan dyes having a basic skeleton selected from indoaniline dyes represented by formula (C5) and anthraquinone dyes represented by formula (C6):

(C5)

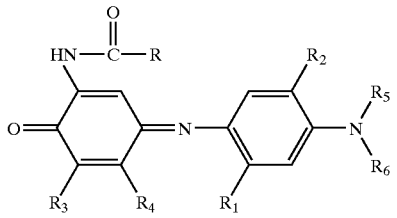

wherein $R_1$ represents a hydrogen atom; an alkyl group optionally substituted by a fluorine atom; an alkoxy group; an alkylamino group; an alkylcarbonylamino group optionally substituted by a fluorine atom; or a halogen atom, $R_2$ represents a hydrogen atom; an alkyl group optionally substituted by a fluorine atom; an alkoxy group; or a halogen atom, $R_3$ and $R_4$ represent a hydrogen atom; an alkyl group optionally substituted by a fluorine atom; an alkoxy group; or a halogen atom, and R, $R_5$, and $R_6$ represent a hydrogen atom, a $C_1$ to $C_6$ substituted or unsubstituted alkyl group, an aryl group, or an alkoxy group; and (C6)

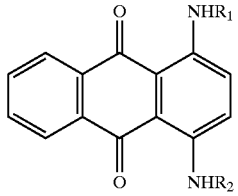

wherein $R_1$ and $R_2$ represent a substituted or unsubstituted alkyl group, a substituted or unsubstituted aryl group, a substituted or unsubstituted allyl group, or a substituted or unsubstituted aralkyl group.

The binder resin used in the dye layer 43 may be a binder resin used in the conventional thermal transfer sheet used with the thermal dye sublimation transfer method. In particular, polyvinyl acetal resins and polyvinyl butyral resins are preferred.

The dye layer 43 may contain the above dyes in an amount of 1.5 to 15% by weight, preferably 4 to 10% by weight. In addition to the dyes and the binder, if necessary, conventional various additives may be added.

The dye layer 43 may be formed, for example, by dissolving or dispersing the above dyes, the binder, and other additives in a suitable solvent to prepare an ink, coating the ink by conventional means, such as gravure coating, and drying the coating. The thickness of the dye layer 43 may be about 0.1 to 3.0 $\mu$m, preferably about 0.3 to 1.5 $\mu$m.

The heat-resistant slip layer 44 constituting the thermal transfer sheet 41 is provided for preventing heat fusing between a heat device, such as a thermal head, and the substrate sheet 42, realizing smooth traveling of the thermal transfer sheet 41, and removing deposits from the thermal head. The heat-resistant slip layer 44 may be formed of a single resin or a mixture of two or more resins selected from naturally occurring or synthetic resins, for example, cellulosic resins, such as ethylcellulose, hydroxycellulose, hydroxypropylcellulose, methylcellulose, cellulose acetate, cellulose acetate butyrate, and nitrocellulose, vinyl resins, such as polyvinyl alcohol, polyvinyl acetate, polyvinyl butyral, polyvinyl acetal, and polyvinyl pyrrolidone, acrylic resins, such as polymethyl methacrylate, polyethyl acrylate, polyacrylamide, and acrylonitrile-styrene copolymer, polyimide resin, polyamide resin, polyamide-imide resin, polyvinyltoluene resin, coumarone-indene resin, polyester resin, polyurethane resin, and silicone-modified or fluorine-modified urethane. In order to further enhance the heat resistance of the heat-resistant slip layer 44, preferably, among the above resins, a resin containing a reactive group based on a hydroxyl group is used in combination with polyisocyanate or the like as a crosslinking agent to form a crosslinked resin layer.

In order to impart slidability against the thermal head, a solid or liquid release agent or lubricant may be added to the heat-resistant slip layer 44 to impart heat-resistant slipperiness to the heat-resistant slip layer 44. Release agents or lubricants include, for example, various waxes, such as polyethylene wax and paraffin wax, higher aliphatic alcohols, organopolysiloxanes, anionic surfactants, cationic surfactants, amphoteric surfactants, nonionic surfactants, fluorosurfactants, metallic soaps, organic carboxylic acids and derivatives thereof, fluororesin, silicone resin, and fine particles of inorganic compounds such as talc, and silica. The content of the lubricant in the heat-resistant slip layer 44 is about 5 to 50% by weight, preferably about 10 to 30% by weight.

The thickness of the heat-resistant slip layer 44 is about 0.1 to 10 $\mu$m, preferably about 0.3 to 5 $\mu$m.

Materials for the substrate 52 constituting the thermal transfer image-receiving sheet 51 include: synthetic papers, such as polyolefin synthetic paper and polystyrene synthetic paper, naturally occurring fiber paper, such as wood free paper, art paper, coated paper, cast coated paper, wall paper, backing paper, synthetic resin solution- or emulsion-impregnated paper, synthetic rubber latex-impregnated paper, paper with synthetic resin internally added thereto, paperboard, and other cellulose fiber paper; and films or sheets of various plastics, for example, polyolefin, polyvinyl chloride, polyethylene terephthalate, polystyrene, polymethyl methacrylate, and polycarbonate. Composites of the above materials may also be used. In the case of the synthetic paper, preferably, the synthetic paper has on its surface a microvoid layer having low coefficient of thermal conductivity (i.e., having high heat insulating properties).

The receptive layer 53 constituting the thermal transfer image-receiving sheet 51 may be formed of one or at least two cellulose ester resins selected, for example, from cellulose diacetate, cellulose triacetate, cellulose acetate propionate (CAP), and cellulose acetate butyrate (CAB).

The receptive layer 53 may contain a thermoplastic resin, compatible with the cellulose ester resin, in an amount of not more than 40 parts by weight based on 100 parts by weight of the cellulose ester resin. Thermoplastic resins usable herein include the following resins.

(i) Resins having ester bond including polyester resins, polyacrylic ester resins, polycarbonate resins, polyvinyl acetate resins, styrene acrylate resins, and vinyltoluene acrylate resins.

(ii) Resins having urethane bond including polyurethane resins.

(iii) Resins having amide bond including polyamide resins.

(iv) Resins having urea bond including urea resins.

(v) Other resins including styrene-maleic anhydride resins, polyvinyl chloride resins, polyacrylonitrile resins, styrene resins, styrene copolymer resins, polyvinyl alcohol resins, cellulose ether resins, gum resins, polyvinyl butyral resins, ionomer resins, and olefin resins.

The receptive layer 53 may further comprise not more than 15% by weight of at least one plasticizer selected from phthalic acid plasticizers, phosphate plasticizers, polycaprolactones, and polyester plasticizers.

The thermal transfer image-receiving sheet 51 may comprise an intermediate layer between the substrate 52 and the receptive layer 53. In this case, the intermediate layer refers to all layers provided between the substrate 52 and the receptive layer 53 and may have a multilayer structure. Examples of functions of the intermediate layer include solvent resistance imparting function, barrier property imparting function, adhesion imparting function, whiteness imparting function, opaqueness imparting function, and antistatic function. The function of the intermediate layer, however, is not limited to these only, and all the conventional intermediate layers may be used.

In order to impart the solvent resistance and the barrier property to the intermediate layer, a water-soluble resin is preferably used. Water-soluble resins include cellulosic resins, such as carboxymethylcellulose, polysaccharide resins such as starch, proteins such as casein, gelatin, agar, vinyl resins, such as polyvinyl alcohol, ethylene-vinyl acetate copolymer, polyvinyl acetate, vinyl chloride-vinyl acetate copolymer, for example, Veova manufactured by Japan Epoxy Resin, vinyl acetate-(meth)acryl copolymer, (meth)acrylic resin, styrene-(meth)acryl copolymer, and styrene resin, melamine resin, urea resin, benzoguanamine resin and other polyamide resins, polyester, and polyurethane. Here the water-soluble resin refers to a resin which, when added to a solvent composed mainly of water, is fully dissolved to prepare a solution (particle diameter: not more than 0.01 $\mu$m), forms a colloidal dispersion (particle diameter: 0.01 to 0.1 $\mu$m), forms an emulsion (particle diameter: 0.1 to 1 $\mu$m), or forms a slurry (particle diameter: not less than 1 $\mu$m). Among these water-soluble resins, resins, which are not dissolved and are not even swollen in general-purpose solvents, for example, alcohols such as methanol, ethanol, and isopropyl alcohol, hexane, cyclohexane, acetone, methyl ethyl ketone, xylene, ethyl acetate, butyl acetate, and toluene, are particularly preferred. In this sense, resins, which are fully dissolved in a solvent composed mainly of water, are most preferred. Among others, polyvinyl alcohol resins and cellulose resins are preferred.

In order to impart the adhesion to the intermediate layer, urethane resin and polyolefin resin are generally used although the type of the resin varies depending upon the type of the substrate 52 and the surface treatment of the substrate sheet. Further, the combined use of a thermoplastic resin having active hydrogen and a curing agent, such as an isocyanate compound, can provide good adhesion.

In order to impart whiteness to the intermediate layer, a brightening agent may be used. The brightening agent may be any conventional compound, and examples thereof include stilbene, distilbene, benzoxazole, styryl-oxazole, pyrene-oxazole, coumarin, aminocoumarin, imidazole, benzimidazole, pyrazoline, and distyryl-biphenyl brightening agents. The whiteness can be regulated by varying the type of the brightening agent and the amount of the brightening agent added. The brightening agent may be added by any method. Specific examples of methods usable herein include a method wherein the brightening agent is dissolved in water to prepare a solution which is then added, a method wherein the brightening agent is pulverized by means of a ball mill or a colloid mill to prepare a powder which is then added, a method wherein the brightening agent is dissolved in a high-boiling solvent to prepare a solution and the solution is then mixed with a hydrophilic colloid solution to prepare an oil-in-water type dispersion which is then added, and a method wherein the brightening agent is impregnated with a polymer latex and, in this state, is added.

Further, the addition of titanium oxide in the intermediate layer to conceal glare and lack of uniformity of the substrate 52 can advantageously further increase the degree of freedom in the selection of the substrate 52. Two types of titanium oxide, i.e., rutile titanium oxide and anatase titanium oxide, are available. When the whiteness and the effect of the brightening agent are taken into consideration, however, the anatase titanium oxide, which absorbs ultraviolet region of shorter wavelengths than the rutile titanium oxide, is preferred. When the binder resin in the intermediate layer is used with water and titanium oxide is less likely to be dispersed, titanium oxide having a hydrophilized surface may be used, or alternatively titanium oxide may be dispersed with the aid of a conventional dispersant such as a surfactant or ethylene glycol. The amount of titanium oxide added is preferably 10 to 400 parts by weight on a solid titanium oxide basis based on 100 parts by weight of the resin on a solid basis.

In order to impart antistatic function to the intermediate layer, proper conventional conductive materials, for example, conductive inorganic fillers or organic conductive agents such as polyanilinesulfonic acid may be selected and used according to the binder resin in the intermediate layer.

The thickness of the intermediate layer is preferably in the range of about 0.1 to 10 $\mu$m.

Figure 5:
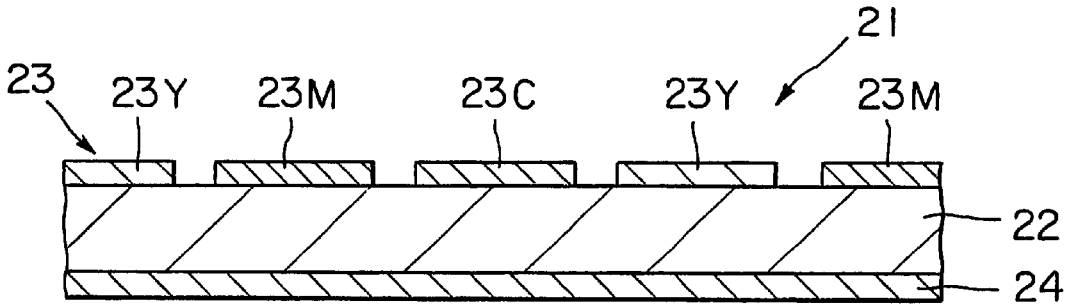
FIG. 5 is a schematic cross-sectional view showing another embodiment of the thermal transfer sheet constituting the thermal transfer recording material according to the present invention.

FIG. 5 is a schematic cross-sectional view showing another embodiment of the thermal transfer sheet constituting the thermal transfer recording material according to the present invention. In a thermal transfer sheet 21 shown in FIG. 5, dye layers 23 (23Y, 23M, and 23C) containing respective sublimable dyes of hues of yellow, magenta, and cyan are provided in a face serial manner on one side of a substrate sheet 22, and a heat-resistant slip layer 24 is provided on the other side of the substrate sheet 22.

The substrate sheet 22 and the heat-resistant slip layer 24 constituting the thermal transfer sheet 21 may be the same as the substrate sheet 2 and the heat-resistant slip layer 4 constituting the thermal transfer sheet 1. The explanation thereof will be omitted.

As with the dye layers 3 constituting the thermal transfer sheet 1, the dye layers 23Y, 23M, and 23C constituting the thermal transfer sheet 21 each are a thermally sublimable colorant layer comprising at least a dye and a binder resin. The dyes include at least two dyes having an identical basic skeleton, and the dyes having an identical basic skeleton include at least one combination of dyes which are different from each other in melting point by 10° C. or above, preferably by 10 to 90° C., more preferably by 10 to 70° C. In the dye layer 23Y, the use of yellow dyes having a basic skeleton selected from quinophthalone dyes represented by formula (C1) and dicyanostyryl dyes represented by formula (C2) is preferred. In the dye layer 23M, the use of magenta dyes having a basic skeleton selected from imidazoleazo dyes represented by formula (C3) and anthraquinone dyes represented by formula (C4) is preferred. In the dye layer 23C, the use of cyan dyes having a basic skeleton selected from indoaniline dyes represented by formula (C5) and anthraquinone dyes represented by formula (C6) is preferred. When the difference in melting point exceeds 90° C., these dyes could not be successfully used as dyes which are transferred by heat energy, that is, transferability is disadvantageously lowered.

The binder resin used in the dye layers 23Y, 23M, and 23C may be any binder resin commonly used in the conventional thermal transfer sheet used with the thermal dye sublimation transfer method. In particular, polyvinyl acetal resin and polyvinyl butyral resin are preferred.

The dye layers 23Y, 23M, and 23C may contain the above dyes in an amount of 1.5 to 15% by weight, preferably 4 to 10% by weight. In addition to the dyes and the binder, if necessary, various conventional additives may be contained in the dye layers.

Figure 6:
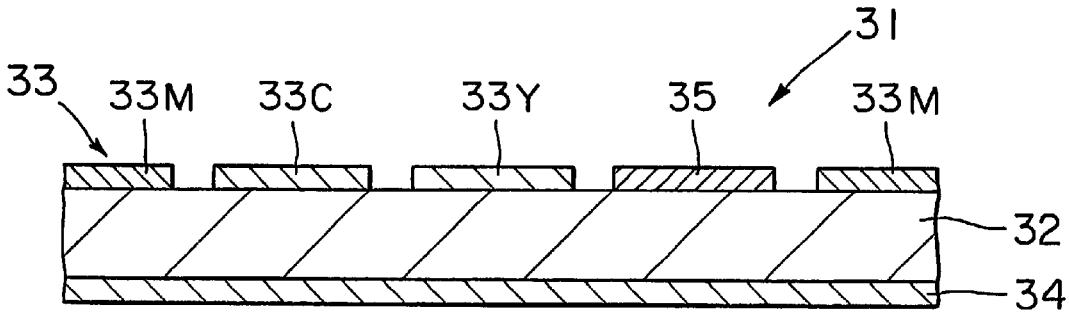
FIG. 6 is a schematic cross-sectional view showing a further embodiment of the thermal transfer sheet constituting the thermal transfer recording material according to the present invention.

FIG. 6 is a schematic cross-sectional view showing a further embodiment of the thermal transfer sheet constituting the thermal transfer recording material according to the present invention. A thermal transfer sheet 31 shown in FIG. 6 is a composite thermal transfer sheet. In this composite thermal transfer sheet, dye layers 33 (33Y, 33M, and 33C) containing respective sublimable dyes of hues of yellow, magenta, and cyan and a transferable protective layer 35 are provided in a face serial manner on one side of a substrate sheet 32, and a heat-resistant slip layer 34 is provided on the other side of the substrate sheet 32 for the dye layers.

The substrate sheet 32 and the heat-resistant slip layer 34 constituting the thermal transfer sheet 31 may be the same as the substrate sheet 42 and the heat-resistant slip layer 44 constituting the thermal transfer sheet 41, and the dye layers 33 constituting the thermal transfer sheet 31 may be the same as the dye layers 23 constituting the thermal transfer sheet 21. Therefore, the explanation thereof will be omitted.

The transferable protective layer 35 constituting the thermal transfer sheet 31 is transferred onto the print face. The purpose of the provision of the protective layer is to impart various types of fastness or resistance properties, such as mar or scratch resistance, and, in addition, chemical resistance and solvent resistance, to the print face. The transferable protective layer 35 may have a single-layer structure. In this case, the transferable protective layer 35 may have a single-layer structure wherein the protective layer is provided on the substrate sheet 32 through a release layer. Further, the transferable protective layer 35 may have a multilayer structure, for example, wherein a peel layer, a function layer, and an adhesive layer are stacked in that order as viewed from the substrate sheet 32 side, or alternatively may have a multilayer structure wherein a multilayer of a peel layer, a function layer, and an adhesive layer is provided through a release layer on the substrate sheet 32. The peel layer, the function layer, and the adhesive layer constituting the protective layer having the multilayer structure each may have a multilayer structure. The function layer or the adhesive layer and the peel layer may serve also as function layers such as a security layer, a hologram layer, and a barrier layer, and various conventional constructions may be adopted.

Thus, the thermally transferable protective layer 35 may be formed of a conventional resin for the formation of a protective layer. Resins usable for the formation of a protective layer include, for example, thermoplastic resins, for example, polyester resins, polycarbonate resins, polyvinyl homopolymers and copolymer resins, such as polyacrylic esters, polystyrenes, polyacryl-styrene, polyacrylonitrile-styrene, polyvinyl-acetoacetal, polyvinyl-butyral, polyvinyl chloride, and polyvinyl chloride-vinyl acetate, polyurethane resins, acryl-urethane resins, epoxy resins, phenoxy resins, resins produced by modifying these resins with silicone, alicyclic polyolefin resins, and cellulose derivative resins such as cellulose esters and cellulose ethers. Mixtures of resins and crosslinking resins include ionizing radiation-crosslinkable resins, ultraviolet screening resins, and heat-crosslinkable resins using the above thermoplastic resins used with crosslinking agents such as isocyanate compounds or chelate compounds. Further, mixtures of the above materials may also be used.

The protective layer formed from the ionizing radiation-crosslinkable resin or the crosslinkable resin such as the heat-crosslinkable resin is excellent particularly in plasticizer resistance and mar or scratch resistance. The ionizing radiation-crosslinkable resin may be any conventional one. For example, a radically polymerizable polymer or oligomer may be crosslinked and cured by ionizing radiation irradiation, or alternatively a photopolymerization initiator may be optionally added followed by polymerization and crosslinking by electron beam or ultraviolet light irradiation. The above ionizing radiation-crosslinkable resin is generally used in the formation of the function layer constituting the transferable protective layer 35. The above ionizing radiation-crosslinkable resin may also be used in the formation of the peel layer or the adhesive layer.

When an antistatic agent is contained in the transferable protective layer 35 having a multilayer structure, the antistatic agent may be contained in at least one of the peel layer, the function layer, and the adhesive layer constituting the protective layer. The antistatic agent may be any conventional antistatic agent and is not particularly limited. The content of the antistatic agent in the protective layer may be properly determined by taking into consideration the type of the antistatic agent used, the thickness of the protective layer and the like and, for example, may be in the range of 1 to 50% by weight. When the content of the antistatic agent is below the lower limit of the above-defined content range, satisfactory antistatic action cannot be developed in the protective layer. On the other hand, when the content of the antistatic agent is above the upper limit of the above-defined content range, unfavorable phenomena, such as deteriorated transparency and deteriorated durability of the protective layer, occur.

The transferable protective layer 35 may contain substantially transparent inorganic or organic fine particles. The incorporation of these fine particles can improve the transferability of the protective layer 35 and, at the same time, can improve the mar or scratch resistance and the like of the protective layer. In addition, the incorporation of these fine particles can reduce the surface gloss of the protective layer to realize a matte surface and can impart writing quality. The fine particles include relatively highly transparent fine particles of silica, polytetrafluoroethylene powder, nylon powder, powdered silica, and colloidal silica. The amount of the fine particles used is preferably 0.1 to 10% by weight based on the synthetic resin. When the amount of the fine particles used exceeds 10% by weight, the transparency and the durability of the protective layer are disadvantageously deteriorated.

The incorporation of additives, such as ultraviolet screening resins, ultraviolet absorbers, antioxidants, and brightening agents, into the transferable protective layer 35 can improve, for example, gloss, lightfastness, weathering resistance, and whiteness of images and the like covered by the transferred protective layer.

The transferable protective layer 35 may be formed on the substrate sheet 32, for example, by adding optional additives, such as antistatic agents and waxes, to the synthetic resin to prepare an ink, coating the ink onto a substrate sheet or onto an already formed release layer by conventional means, such as gravure coating, gravure reverse coating, or roll coating, and drying the coating. The thickness of the protective layer may be, for example, about 0.5 to 10 $\mu$m, preferably about 1 to 4 $\mu$m, although the thickness varies also depending upon the combination of the layers constituting the protective layer.

As described above, a release layer may be provided from the viewpoint of regulating the adhesion between the substrate sheet 32 and the transferable protective layer 35 and realizing good separation of the protective layer. The release layer may be a conventional release layer. The release layer may be formed by coating a coating liquid containing at least one member selected from waxes, silicone waxes, silicone resins, fluororesins, styrene resins, acrylonitrile-styrene resins, epoxy-containing acrylic resins, acrylic resins, water-soluble resins, cellulose derivative resins, urethane resins, vinyl chloride-vinyl acetate copolymers, ionomer resins, maleic anhydride resins, and copolymers of a group of these resins, for example, silicone-modified epoxy-containing acrylic resins and acryl-styrene resins by a conventional coating method and drying the coating. The thickness of the release layer may be about 0.1 to 2 $\mu$m.

Further, the release layer may contain an antistatic agent. In this case, the content of the antistatic agent may be properly determined by taking into consideration, for example, the type of the antistatic agent used and the thickness of the release layer and may be, for example, in the range of 1 to 50% by weight.

When the release layer is provided, it should be noted that the release layer should be formed so that, upon transfer, the transferable protective layer 35 is separated from the release layer and the release layer per se is left on the substrate sheet 32 side. Specifically, it is important that the adhesion between the release layer and the substrate sheet 32 be higher than the adhesion between the release layer and the protective layer. When the adhesion between the release layer and the substrate sheet 32 is smaller than the adhesion between the release layer and the protective layer, abnormal transfer, for example, the transfer of the release layer together with the transferable protective layer 35, disadvantageously occurs.

(Form of Thermal Transfer Image-receiving Sheet)

Photograph-like hand is preferred in digital photographs. For this reason, a high-gloss, high-rigidity thermal transfer image-receiving paper using, for example, a substrate comprising porous PET laminated onto a substrate for a thermal transfer image-receiving sheet is preferred.

Since, however, this image-receiving paper is highly rigid, when the edge of each corner of the image-receiving paper is in the form of a sharp right angle, upon the scratch of the surface of another image-receiving paper by the image-receiving paper during the production of the image-receiving papers or during handling of image-receiving papers such as loading of image-receiving papers into a printer, damage to the surface of the receptive layer in the image-receiving paper is disadvantageously likely to occur. Further, since the image-receiving paper is highly glossy, the damage to the surface of the image-receiving paper is prominent. The highly rigid image-receiving paper suffers from an additional problem of safety, i.e., a problem that, at the time of handling, a hand is likely to be injured by the image-receiving paper.

In order to solve the above problems, the provision of roundness R in the shape of four corners of the quadrangle is considered effective. According to the present inventor's finding, however, when the diameter of R of the corner is a given value or more, the carriability of the image-receiving paper is significantly lowered. This disadvantageously imposes mechanical limitation at the time of sheet feeding or carrying in a printer. More specifically, when the image-receiving paper loaded into the printer is grasped and carried or conveyed by a feed roller, large R at both ends defining one side of the front position of the image-receiving paper renders the grasping of the image-receiving paper at its both ends by the feed roller unavoidably unsatisfactory. As a result, stable carriage is inhibited.

In order to overcome the above problem, forming is carried out in such a manner that the shape of each of the four corners in the image-receiving sheet is relatively slightly rounded, that is, R of each of the four corners in the image-receiving sheet is R1 to R5, preferably R1 to R3, more preferably R1 to R2. The adoption of this form can provide an image-receiving sheet which has high gloss and high rigidity, can eliminate the problems of the prior art, i.e., the problem of damage to the surface of the image-receiving paper and injuring of the hand by the image-receiving paper, and, at the same time, has good carriability.

Accordingly, the present invention includes a thermal transfer image-receiving sheet having the above R shape. In general, in the image-receiving sheet, both the step of lamination and the step of coating, processing are carried out in a roll form. Therefore, for efficient processing, preferably, forming into the above shape is carried out by punching using a blade having a shape conforming to the shape of the image-receiving paper.

Thus, in an embodiment of the present invention, there is provided an image-receiving sheet comprising a substrate and, provided on the substrate, a receptive layer comprising a thermoplastic resin colorable with a disperse dye, the glossiness of the image-receiving sheet in its receiving face being not less than 50%, each corner of the image-receiving sheet being in a form having a roundness in the range of R1 to R5, preferably R1 to R3, more preferably R1 to R2.

In the image-receiving sheet according to this embodiment, a laminate substrate having a total thickness of not less than 150 $\mu$m may be used in which a porous PET film is provided as an outermost surface layer in the image-receiving sheet.

EXAMPLES

The following examples and comparative examples further illustrate the present invention. In the following description, "parts" or "%" is by weight unless otherwise specified.

Example A

Example A0

A synthetic paper (Yupo FPG-150, thickness 150 $\mu$m, manufactured by Yupo Corporation (Oji-Yuka)) was provided as a substrate sheet. A coating liquid for an intermediate layer having the following composition and a coating liquid for a receptive layer having the following composition were coated on one side of the substrate sheet by means of a wire bar at a coverage of 1.0 g/m$^2$ on a dry basis and a coverage of 2.5 g/m$^2$ on a dry basis, respectively, followed by drying to prepare a thermal transfer image-receiving sheet of Example A0 according to the present invention.

| (Composition of coating liquid for intermediate layer) | |
|---|---|
| Polyester resin (Vylon 200, manufactured by Toyobo Co., Ltd.) | 10 parts |
| Titanium oxide (TCA-888, manufactured by Tohchem Products Corporation) | 20 parts |
| Methyl ethyl ketone/toluene (weight ratio = 1/1) | 120 parts |

-continued

| (Composition of coating liquid for receptive layer) | |
|---|---|
| Cellulose acetate butyrate (CAB 551-0.2, manufactured by Eastman Chemical Co.) | 60 parts |
| Cellulose acetate butyrate (CAB 321-0.1, manufactured by Eastman Chemical Co.) | 40 parts |
| Polycaprolactone (Placcel H-5, manufactured by Daicel Chemical Industries, Ltd.) | 10 parts |
| Polyether-modified silicone (KF-6012, manufactured by The Shin-Etsu Chemical Co., Ltd.) | 0.5 part |
| Methyl ethyl ketone/toluene (weight ratio = 1/1) | 440 parts |

Example A1

A synthetic paper (Yupo FPG-150, thickness 150 $\mu$m, manufactured by Yupo Corporation (Oji-Yuka)) was provided as a substrate sheet. A coating liquid for an intermediate layer having the following composition and a coating liquid for a receptive layer having the following composition were coated on one side of the substrate sheet by means of a wire bar at a coverage of 1.0 g/m$^2$ on a dry basis and a coverage of 2.5 g/m$^2$ on a dry basis, respectively, followed by drying to prepare a thermal transfer image-receiving sheet of Example A1 according to the present invention.

| (Composition of coating liquid for intermediate layer) | |
|---|---|
| Polyester resin (Vylon 200, manufactured by Toyobo Co., Ltd.) | 10 parts |
| Titanium oxide (TCA-888, manufactured by Tohchem Products Corporation) | 20 parts |
| Methyl ethyl ketone/toluene (weight ratio = 1/1) | 120 parts |
| (Composition of coating liquid for receptive layer) | |
| Cellulose acetate butyrate (CAB 551-0.2, manufactured by Eastman Chemical Co.) | 35 parts |
| Cellulose acetate butyrate (CAB 381-0.1, manufactured by Eastman Chemical Co.) | 65 parts |
| Polycaprolactone (Placcel H-5, manufactured by Daicel Chemical Industries, Ltd.) | 10 parts |
| Polyether-modified silicone (KF-6012, manufactured by The Shin-Etsu Chemical C0., Ltd.) | 0.5 part |
| Methyl ethyl ketone/toluene (weight ratio = 1/1) | 440 parts |

Example A2

A thermal transfer image-receiving sheet of Example A2 according to the present invention was prepared in the same manner as in Example A1, except that the receptive layer was formed using the following coating liquid instead of the coating liquid in Example A1.

| (Composition of coating liquid for receptive layer) | |
|---|---|
| Cellulose acetate butyrate (CAB 551-0.2, manufactured by Eastman Chemical Co.) | 50 parts |
| Cellulose acetate butyrate (CAB 321-0.1, manufactured by Eastman | 50 parts |

-continued

| (Composition of coating liquid for receptive layer) | |
|---|---|
| Chemical Co.) | |
| Polycaprolactone (Placcel H-5, manufactured by Daicel Chemical Industries, Ltd.) | 10 parts |
| Polyether-modified silicone (KF-6012, manufactured by The Shin-Etsu Chemical Co., Ltd.) | 0.5 part |
| Methyl ethyl ketone/toluene (weight ratio = 1/1) | 440 parts |

Example A3

A thermal transfer image-receiving sheet of Example A3 according to the present invention was prepared in the same manner as in Example A1, except that the receptive layer was formed using the following coating liquid instead of the coating liquid in Example A1.

| (Composition of coating liquid for receptive layer) | |
|---|---|
| Cellulose acetate butyrate (CAB 551-0.2, manufactured by Eastman Chemical Co.) | 20 parts |
| Cellulose acetate butyrate (CAB 381-0.1, manufactured by Eastman Chemical Co.) | 80 parts |
| Polycaprolactone (Placcel H-5, manufactured by Daicel Chemical Industries, Ltd.) | 10 parts |
| Polyether-modified silicone (KF-6012, manufactured by The Shin-Etsu Chemical Co., Ltd.) | 0.5 part |
| Methyl ethyl ketone/toluene (weight ratio = 1/1) | 440 parts |

Example A4

A thermal transfer image-receiving sheet of Example A4 according to the present invention was prepared in the same manner as in Example A1, except that the receptive layer was formed using the following coating liquid instead of the coating liquid in Example A1.

| (Composition of coating liquid for receptive layer) | |
|---|---|
| Cellulose acetate butyrate (CAB 551-0.2, manufactured by Eastman Chemical Co.) | 35 parts |
| Cellulose acetate butyrate (CAB 321-0.1, manufactured by Eastman Chemical Co.) | 65 parts |
| Polycaprolactone (Placcel H-5, manufactured by Daicel Chemical Industries, Ltd.) | 10 parts |
| Polyether-modified silicone (KF-6012, manufactured by The Shin-Etsu Chemical Co., Ltd.) | 0.5 part |
| Methyl ethyl ketone/toluene (weight ratio = 1/1) | 440 parts |

Example A5

A thermal transfer image-receiving sheet of Example A5 according to the present invention was prepared in the same manner as in Example A1, except that the receptive layer was formed using the following coating liquid instead of the coating liquid in Example A1.

| (Composition of coating liquid for receptive layer) | |
|---|---|
| Cellulose acetate butyrate (CAB 551-0.2, manufactured by Eastman Chemical Co.) | 25 parts |
| Cellulose acetate butyrate (CAB 321-0.1, manufactured by Eastman Chemical Co.) | 75 parts |
| Polycaprolactone (Placcel H-5, manufactured by Daicel Chemical Industries, Ltd.) | 10 parts |
| Polyether-modified silicone (KF-6012, manufactured by The Shin-Etsu Chemical Co., Ltd.) | 0.5 part |
| Methyl ethyl ketone/toluene (weight ratio = 1/1) | 440 parts |

Comparative Example A1

A thermal transfer image-receiving sheet of Comparative Example A1 was prepared in the same manner as in Example A1, except that the receptive layer was formed using the following coating liquid instead of the coating liquid in Example A1.

| (Composition of coating liquid for receptive layer) | |
|---|---|
| Cellulose acetate butyrate (CAB 551-0.2, manufactured by Eastman Chemical Co.) | 100 parts |
| Polyether-modified silicone (KF-6012, manufactured by The Shin-Etsu Chemical Co., Ltd.) | 0.5 part |
| Methyl ethyl ketone/toluene (weight ratio = 1/1) | 400 parts |

Comparative Example A2

A thermal transfer image-receiving sheet of Comparative Example A2 was prepared in the same manner as in Example A1, except that the receptive layer was formed using the following coating liquid instead of the coating liquid in Example A1.

| (Composition of coating liquid for receptive layer) | |
|---|---|
| Cellulose acetate butyrate (CAB 381-0.2, manufactured by Eastman Chemical Co.) | 100 parts |
| Polyether-modified silicone (KF-6012, manufactured by The Shin-Etsu Chemical Co., Ltd.) | 0.5 part |
| Methyl ethyl ketone/toluene (weight ratio = 1/1) | 400 parts |

Comparative Example A3

A thermal transfer image-receiving sheet of Comparative Example A3 was prepared in the same manner as in Example A1, except that the receptive layer was formed using the following coating liquid instead of the coating liquid in Example A1.

| (Composition of coating liquid for receptive layer) | |
|---|---|
| Cellulose acetate butyrate (CAB 321-0.2, manufactured by Eastman | 100 parts |

-continued

| (Composition of coating liquid for receptive layer) | |
|---|---|
| Chemical Co.) | |
| Polyether-modified silicone (KF-6012, manufactured by The Shin-Etsu Chemical Co., Ltd.) | 0.5 part |
| Methyl ethyl ketone/toluene (weight ratio = 1/1) | 400 parts |

Comparative Example A4

A thermal transfer image-receiving sheet of Comparative Example A4 was prepared in the same manner as in Example A1, except that the receptive layer was formed using the following coating liquid instead of the coating liquid in Example A1.

| (Composition of coating liquid for receptive layer) | |
|---|---|
| Cellulose acetate butyrate (CAB 381-0.1, manufactured by Eastman Chemical Co.) | 100 parts |
| Polycaprolactone (Placcel H-5, manufactured by Daicel Chemical Industries, Ltd.) | 10 parts |
| Polyether-modified silicone (XF-6012, manufactured by The Shin-Etsu Chemical Co., Ltd.) | 0.5 part |
| Methyl ethyl ketone/toluene (weight ratio = 1/1) | 460 parts |

Comparative Example A5

A thermal transfer image-receiving sheet of Comparative Example A5 was prepared in the same manner as in Example A1, except that the receptive layer was formed using the following coating liquid instead of the coating liquid in Example A1.

| (Composition of coating liquid for receptive layer) | |
|---|---|
| Cellulose acetate butyrate (CAB 321-0.1, manufactured by Eastman Chemical Co.) | 100 parts |
| Polycaprolactone (Placcel H-5, manufactured by Daicel Chemical Industries, Ltd.) | 20 parts |
| Polyether-modified silicone (KF-6012, manufactured by The Shin-Etsu Chemical Co., Ltd.) | 0.5 part |
| Methyl ethyl ketone/toluene (weight ratio = 1/1) | 460 parts |

Comparative Example A6

A thermal transfer image-receiving sheet of Comparative Example A6 was prepared in the same manner as in Example A1, except that the receptive layer was formed using the following coating liquid instead of the coating liquid in Example A1.

| (Composition of coating liquid for receptive layer) | |
|---|---|
| Cellulose acetate butyrate (CAB 551-0.2, manufactured by Eastman Chemical Co.) | 70 parts |
| Cellulose acetate butyrate | 30 parts |

-continued

| (Composition of coating liquid for receptive layer) | |
|---|---|
| (CAB 321-0.1, manufactured by Eastman Chemical Co.) | |
| Polycaprolactone (Placcel H-5, manufactured by Daicel Chemical Industries, Ltd.) | 10 parts |
| Polyether-modified silicone (KF-6012, manufactured by The Shin-Etsu Chemical Co., Ltd.) | 0.5 part |
| Methyl ethyl ketone/toluene (weight ratio = 1/1) | 440 parts |

Comparative Example A7

A thermal transfer image-receiving sheet of Comparative Example A7 was prepared in the same manner as in Example A1, except that the receptive layer was formed using the following coating liquid instead of the coating liquid in Example A1.

| (Composition of coating liquid tor receptive layer) | |
|---|---|
| Cellulose acetate butyrate (CAB 551-0.2, manufactured by Eastman Chemical Co.) | 50 parts |
| Cellulose acetate butyrate (CAB 381-0.1, manufactured by Eastman Chemical Co.) | 50 parts |
| Polycaprolactone (Placcel H-5, manufactured by Daicel Chemical Industries, Ltd.) | 10 parts |
| Polyether-modified silicone (KF-6012, manufactured by The Shin-Etsu Chemical Co., Ltd.) | 0.5 part |
| Methyl ethyl ketone/toluene (weight ratio = 1/1) | 440 parts |

Comparative Example A8

A thermal transfer image-receiving sheet of Comparative Example A8 was prepared in the same manner as in Example A1, except that the receptive layer was formed using the following coating liquid instead of the coating liquid in Example A1.

| (Composition of coating liquid for receptive layer) | |
|---|---|
| Cellulose acetate butyrate (CAB 551-0.2, manufactured by Eastman Chemical Co.) | 10 parts |
| Cellulose acetate butyrate (CAB 321-0.1, manufactured by Eastman Chemical Co.) | 90 parts |
| Polycaprolactone (Placcel H-5, manufactured by Daicel Chemical Industries, Ltd.) | 10 parts |
| Polyether-modified silicone (KF-6012, manufactured by The Shin-Etsu Chemical Co., Ltd.) | 0.5 part |
| Methyl ethyl ketone/toluene (weight ratio = 1/1) | 440 parts |

Next, the thermal transfer image-receiving sheets prepared in the examples and the comparative examples were evaluated by the following methods.

Evaluation Methods (Thermal Transfer Recording)

A transfer film UPC-740 as a thermal transfer film for a sublimation dye transfer printer UP-D 70 A manufactured by Sony Corp. and the thermal transfer image-receiving sheets prepared in the examples and the comparative examples were provided. The thermal transfer film and the thermal transfer image-receiving sheet were put on top of each other so that the dye layer faced the dye-receptive surface. Thermal transfer recording was carried out by means of a thermal head under the following conditions from the backside of the thermal transfer film in the order of Y, M, and C (printing condition A). Separately, after an image was recorded under the printing condition A, a protective layer was transferred onto the recorded image (printing condition B).

(Printing Condition A)

A black blotted image was formed by thermal transfer recording under the following conditions.

Thermal head: KYT-86-12 MFW 11, manufactured by Kyocera Corp.

Average resistance value of heating element: 4412Ω

Print density in scanning direction: 300 dpi

Print density in feed direction: 300 dpi

Applied power: 0.136 w/dot

One line period: 6 msec

Printing initiation temp.: 30° C.

Printing of black blotted image: A multipulse-type test printer was used wherein the number of divided pulses with a pulse length obtained by equally dividing one line period into 256 parts is variable from 0 to 255 during one line period. In this case, the duty ratio for each divided pulse was fixed to 70%, the number of pulses per line period was fixed to 255, and blotted images for Y, M, and C were successively printed.

(Printing Condition B)

A gradation image was formed by thermal transfer recording in the same manner as described above, except that gradation control was carried out as follows. Thereafter, a protective layer was transferred.

Gradation printing: A multipulse-type test printer was used wherein the number of divided pulses with a pulse length obtained by equally dividing one line period into 256 parts is variable from 0 to 255 during one line period. In this case, the duty ratio for each divided pulse was fixed to 40%, and, according to the gradation, the number of pulses per line period was brought to 0 for step 1, 17 for step 2, 34 for step 3 and the like. In this way, the number of pulses was successively increased from 0 to 255 by 17 for each step. Thus, 16 gradation steps from step 1 to step 16 were controlled to form a gradation image.

Transfer of protective layer: A multipulse-type test printer was used wherein the number of divided pulses with a pulse length obtained by equally dividing one line period into 256 parts is variable from 0 to 255 during one line period. In this case, the duty ratio for each divided pulse was fixed to 50%, the number of pulses per line period was fixed to 210, and a blotted image was printed to transfer a protective layer on the whole area of the surface of the print.

(Separability)

The prints produced under the printing condition A were visually inspected. The results were evaluated according to the following criteria.

Evaluation criteria:

○ . . . No abnormal transfer phenomenon occurred.

X . . . An abnormal transfer phenomenon, wherein the receptive layer was transferred onto the thermal transfer sheet, or an abnormal transfer phenomenon, wherein the dye binder in the thermal transfer film was transferred onto the image-receiving face, occurred.

(Smudge)

The prints produced under the printing condition A was visually inspected. The results were evaluated according to the following criteria. Evaluation criteria:

○ . . . No smudge occurred.

X . . . Smudge occurred.

(Print Density)

For the prints produced under the printing condition B, the maximum reflection density was measured through a visual filter with an optical reflection densitometer (Macbeth RD-918, manufactured by Macbeth).

Evaluation criteria:

○ . . . Maximum reflection density of not less than 2.0

X . . . Maximum reflection density of less than 2.0

(Blurring)

The prints produced under the printing condition B were stored in a dark place at 60° C. for 200 hr and were then inspected.

Evaluation Criteria:

○ . . . Blurring was not observed.

Δ . . . Although blurring was not observed by visual inspection, inspection through a loupe revealed the occurrence of blurring.

X . . . Blurring was observed by visual inspection.

(Adhesion of Protective Layer)

After the protective layer was transferred under the printing condition B, a cellophane tape was applied to the protective layer transferred face and was separated. In this case, the adhesion of the protective layer in the print onto the tape was visually inspected.

Evaluation criteria:

○ . . . The protective layer remained adhered to the print side without transfer onto the tape side.

X . . . The protective layer was transferred onto the tape side, indicating that the protective layer was not adhered to the print side.

(Lightfastness)

Printing was carried out on the thermal transfer image-receiving sheets prepared in the examples and the comparative examples under the printing condition B. The prints with the protective layer transferred thereon were tested for lightfastness with a xenon fadeometer under the following conditions.

Irradiation tester: Ci 35, manufactured by Atlas

Light source: Xenon lamp

Filter: Inner side=IR filter, outer side=soda-lime/glass

Black panel temp.: 45° C.

Irradiation intensity: 1.2 $W/m^2$ . . . value as measured at 420 nm

Irradiation energy: 400 $kJ/m^2$ . . . integrated value at 420 nm

The optical reflection density was measured through a visual filter with an optical densitometer (Macbeth RD-918, manufactured by Macbeth). For a step wherein the optical reflection density before the irradiation was around 1.0, a difference in optical reflection density before the irradiation and after the irradiation was measured. The retention (%) was then calculated by the following equation to evaluate the lightfastness of each of the thermal transfer image-receiving sheets.

Retention (%)=(optical reflection density after irradiation/optical reflection density before irradiation)×100

Evaluation criteria:

○ . . . Retention of not less than 50%

X . . . Retention of less than 50%

The results of evaluation were as shown in Table A1 below.

TABLE A1

| | Degree of acetylation | Separability | Print density | Smudge | Blurring | Adhesion of protective layer | Light-fastness | Overall evaluation |
|---|---|---|---|---|---|---|---|---|
| Ex. A0 | 8.2% | ○ | ○ 2.15 | ○ | ○ | ○ | ○ 85% | ○ |
| Ex. A1 | 9.5% | ○ | ○ 2.10 | ○ | ○ | ○ | ○ 85% | ○ |
| Ex. A2 | 9.8% | ○ | ○ 2.10 | ○ | ○ | ○ | ○ 84% | ○ |
| Ex. A3 | 11.2% | ○ | ○ 2.07 | ○ | ○ | ○ | ○ 85% | ○ |
| Ex. A4 | 12.1% | ○ | ○ 2.06 | ○ | ○ | ○ | ○ 85% | ○ |
| Ex. A5 | 13.5% | ○ | ○ 2.10 | ○ | ○ | ○ | ○ 86% | ○ |
| Comp. Ex. A1 | 2.0% | X | X 1.86 | ○ | ○ | ○ | ○ 65% | X |
| Comp. Ex. A2 | 13.5% | ○ | X 1.71 | ○ | ○ | X | X 39% | X |
| Comp. Ex. A3 | 17.5% | ○ | X 1.66 | ○ | ○ | X | X 42% | X |
| Comp. Ex. A4 | 13.5% | ○ | X 1.96 | ○ | ○ | X | X 40% | X |
| Comp. Ex. A5 | 17.5% | ○ | ○ 2.08 | X | X | X | X 40% | X |
| Comp. Ex. A6 | 6.7% | X | ○ 2.14 | X | Δ | ○ | ○ 83% | X |
| Comp. Ex. A7 | 7.8% | X | ○ 2.12 | X | Δ | ○ | ○ 86% | X |
| Comp. Ex. A8 | 16.0% | ○ | X 1.90 | ○ | ○ | X | X 41% | X |

As is apparent from the results of evaluation shown in the above table, for Example A5 and Comparative Example A4 which were identical to each other in degree of acetylation and adopted the addition of an identical amount of plasticizer to the receptive layer, in Comparative Example A4 wherein, unlike Example A5, the cellulose ester resin (A) having a degree of acetylation of 10 to 30% was not used in combination with the cellulose ester resin (B) having a degree of acetylation of less than 6%, the print density was low and, in addition, since the protective layer was not adhered to the receptive layer face and thus could not be transferred onto the image, the lightfastness was poor.

As is apparent from the foregoing detailed description, the present invention can provide a thermal transfer image-receiving sheet which can realize printing of highly dyeable images at a high speed, has good separation from the thermal transfer sheet, is free from blurring and smudge caused by plasticizers, and can permit the adhesion of the protective layer onto the receptive layer. These effects can be attained by the construction of the present invention wherein, in the thermal transfer image-receiving sheet comprising a substrate sheet and a receptive layer provided on at least one side of the substrate sheet, the receptive layer is formed of a combination of a cellulose ester resin (A) having a degree of acetylation of 10 to 30% with a cellulose ester resin (B) having a degree of acetylation of less than 6%, the total degree of acetylation of the cellulose ester resins (A) and (B) is 8 to 14%, the content of hydroxyl group in the cellulose ester resin (A) and the content of hydroxyl group in the cellulose ester resin (B) are each not more than 6% by weight, and the other hydroxyl groups have been esterified with an organic acid excluding acetic acid.

Further, after the formation of an image on the thermal transfer image-receiving sheet in its image receiving face, the transfer of the protective layer into the image formed face can provide a highly lightfast and durable print.

EXAMPLE B

The following silicones were used in the following examples.

Si 1: Grafting type: siloxane content 30 wt %, EO/PO=20/80 wt %, HLB value=5

Si 2: Grafting type: siloxane content 30 wt %, EO/PO=35/65 wt %, HLB value=7

Si 3: Grafting type: siloxane content 30 wt %, EO/PO=50/50 wt %, HLB value=9

Si 4: End modification type: siloxane content 30 wt %, EO/PO=50/50 wt %, HLB value=7

Si 5: Main chain polymerization type: siloxane content 30 wt %, EO/PO=50/50 wt %, HLB value=7

Si 6: Grafting type: siloxane content 30 wt %, EO/PO=65/35 wt %, HLB value=7

Si 7: Grafting type: siloxane content 30 wt %, EO/PO=80/20 wt %, HLB value=7

Si 8: Grafting type: siloxane content 60 wt %, EO/PO=50/50 wt %, HLB value=7

Si 9: Main chain polymerization type: siloxane content 60 wt %, EO/PO=75/15 wt %, HLB value=7

Si 10: Grafting type: siloxane content 30 wt %, EO/PO=100/0 wt %, HLB value=1

Si 11: Grafting type: siloxane content 30 wt %, EO/PO=0/100 wt %, HLB value=1

Si 12: Grafting type: siloxane content 20 wt %, EO/PO=50/50 wt %, HLB value=7

Si 13: Grafting type: siloxane content 70 wt %, EO/PO=50/50 wt %, HLB value=1

Si 14: Addition polymerization type silicone (a mixture of 1 part by weight of a vinyl-modified silicone represented by formula (B4) with 2 parts by weight of a hydrogen-modified silicone represented by formula (B5), percentage substitution of methyl group by phenyl group=each 30 mol %; molecular weight=each about 7000; amount of reaction group in vinyl-modified silicone=about 15 mol %; in hydrogen-modified silicone, both ends $R_2$, $R_3$=—$CH_3$, side chain=—H, amount of reaction group=about 30 mol %)

(B4)

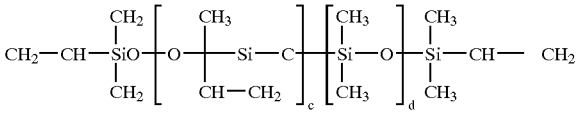

wherein m and n are each an integer of not more than 2000.

(B5)

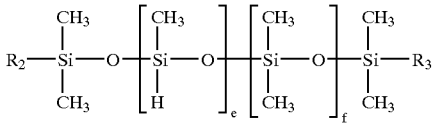

wherein e and f are each an integer of not more than 2000.

Si 15: Epoxy-modified silicone

Example B1

A 150 μm-thick synthetic paper YUPO FPG #150 (manufactured by Yupo Corporation (Oji-Yuka)) was provided as a substrate sheet. A coating liquid for an intermediate layer having the following composition was coated by means of a wire bar on one side of the substrate sheet at a coverage of 1.5 g/m$^2$ on a dry basis, and the coating was dried at 110° C. for 30 sec. Thereafter, a coating liquid for a receptive layer having the following composition was coated thereon at a coverage of 3.0 g/m$^2$ on a dry basis, and the coating was dried at 110° C. for 60 sec to prepare a thermal transfer image-receiving sheet 1 of the present invention.

| | |
|---|---|
| (Coating liquid for intermediate layer) | |
| Polyester (MD 120O, manufactured by Toyobo Co., Ltd.) | 10 parts |
| Titanium oxide (TCA-888, manufactured by Tohchem Products Corporation) | 20 parts |
| Water/IPA (2:1) | 120 parts |
| (Coating liquid tor receptive layer) | |
| Cellulose ester (CAB 551-0.2, manufactured by Eastman Kodak) | 20 parts |
| Polyether-modified silicone (Si 1) | 1 part |
| Methyl ethyl ketone/toluene = 1/1 | 80 parts |

Examples B2 to B9

Image-receiving sheets 2 to 9 of the present invention were prepared in the same manner as in Example B1, except that Si 2 to Si 9 were used instead of the polyether-modified silicone (Si 1) in the coating liquid for a receptive layer in Example B1.

Example B10

An image-receiving sheet 10 of the present invention was prepared in the same manner as in Example B1, except that a coating liquid for a receptive layer having the following composition was used instead of the coating liquid for a receptive layer in Example B1.

| | |
|---|---|
| Cellulose ester (CAB 551-0.2, manufactured by Eastman Kodak) | 20 parts |
| Polyether-modified silicone (Si 3) | 0.1 part |
| Methyl ethyl ketone/toluene = 1/1 | 80 parts |

Example B11

An image-receiving sheet 11 of the present invention was prepared in the same manner as in Example B1, except that a coating liquid for a receptive layer having the following composition was used instead of the coating liquid for a receptive layer in Example B1.

| | |
|---|---|
| Cellulose ester (CAB 551-0.2, manufactured by Eastman Kodak) | 20 parts |
| Polyether-modified silicone (Si 3) | 2 parts |
| Methyl ethyl ketone/toluene = 1/1 | 80 parts |

Example B12

An image-receiving sheet 12 of the present invention was prepared in the same manner as in Example B1, except that a coating liquid for a receptive layer having the following composition was used instead of the coating liquid for a receptive layer in Example B1.

| | |
|---|---|
| Cellulose ester (CAB 551-0.2, manufactured by Eastman Kodak) | 20 parts |
| Polyether-modified silicone (Si 3) | 2.4 parts |
| Methyl ethyl ketone/toluene = 1/1 | 80 parts |

Example B13

An image-receiving sheet 13 of the present invention was prepared in the same manner as in Example B1, except that a coating liquid for a receptive layer having the following composition was used instead of the coating liquid for a receptive layer in Example B1.

| | |
|---|---|
| Cellulose ester (CAE 551-0.2, manufactured by Eastman Kodak) | 20 parts |
| Polyether-modified silicone (Si 3) | 1 part |
| Epoxy-modified silicone (epoxy modification 50%, methylstyrene modification 50%) | 10 parts |
| Methyl ethyl ketone/toluene = 1/1 | 80 parts |

Example B14

An image-receiving sheet 14 of the present invention was prepared in the same manner as in Example B1, except that a coating liquid for a receptive layer having the following composition was used instead of the coating liquid for a receptive layer in Example B1.

| | |
|---|---|
| Cellulose ester (CAB 381-0.1, manufactured by Eastman Kodak) | 17 parts |
| Polycaprolactone (Placcel H5, manufactured by Daicel Chemical Industries, Ltd.) | 3 parts |
| Polyether-modified silicone (Si 3) | 1 part |
| Methyl ethyl ketone/toluene = 1/1 | 80 parts |

Example B15

An image-receiving sheet 15 of the present invention was prepared in the same manner as in Example B1, except that a coating liquid for a receptive layer having the following composition was used instead of the coating liquid for a receptive layer in Example B1.

| | |
|---|---|
| Cellulose ester (CAB 321-0.1, manufactured by Eastman Kodak) | 17 parts |
| Polycaprolactone (Placcel H5, manufactured by Daicel Chemical Industries, Ltd.) | 3 parts |
| Polyether-modified silicone (Si 3) | 1 part |
| Methyl ethyl ketone/toluene = 1/1 | 80 parts |

Example B16

An image-receiving sheet 16 of the present invention was prepared in the same manner as in Example B1, except that a coating liquid for a receptive layer having the following composition was used instead of the coating liquid for a receptive layer in Example B1.

| | |
|---|---|
| Cellulose ester (CAB 321-0.1, manufactured by Eastman Kodak) | 12 parts |
| Cellulose ester (CAB 551-0.2, manufactured by Eastman Kodak) | 6 parts |
| Polycaprolactone (Placcel H5, manufactured by Daicel Chemical Industries, Ltd.) | 2 parts |
| Polyether-modified silicone (Si 3) | 1 part |
| Methyl ethyl ketone/toluene = 1/1 | 80 parts |

Example B17

An image-receiving sheet 17 of the present invention was prepared in the same manner as in Example B1, except that a coating liquid for a receptive layer having the following composition was used instead of the coating liquid for a receptive layer in Example B1.

| | |
|---|---|
| Polycarbonate (50/50 copolymer of bisphenol A/bisphenol A) | 20 parts |
| Polyether-modified silicone (Si 3) | 0.4 part |
| Methyl ethyl ketone/toluene = 1/1 | 80 parts |

Example B18

An image-receiving sheet 18 of the present invention was prepared in the same manner as in Example B1, except that a coating liquid for a receptive layer having the following composition was used instead of the coating liquid for a receptive layer in Example B1.

| | |
|---|---|
| Acryl styrene (70/30 copolymer of benzyl methacrylate/styrene) | 20 parts |
| Polyether-modified silicone (Si 3) | 0.4 part |
| Methyl ethyl ketone/toluene = 1/1 | 80 parts |

Comparative Example B1

An image-receiving sheet 1 of Comparative Example B1 was prepared in the same manner as in Example B1, except that a coating liquid for a receptive layer having the following composition was used instead of the coating liquid for a receptive layer in Example B1.

| | |
|---|---|
| Cellulose ester (CAB 551-0.2, manufactured by Eastman Kodak) | 20 parts |
| Methyl ethyl ketone/toluene = 1/1 | 80 parts |

Comparative Examples B2 to B7

Image-receiving sheets 2 to 7 of Comparative Examples B2 to B7 were prepared in the same manner as in Example B1, except that Si 10 to Si 15 were used instead of the polyether-modified silicone (Si 1) in the coating liquid for a receptive layer in Exapmle B1.

Evaluation Method

Thermal Transfer Recording

A thermal transfer film PK 700 L for a video printer CP-700, manufactured by Mitsubishi Electric Corporation and the thermal transfer image-receiving sheets prepared in the examples and the comparative examples were provided. The thermal transfer film and the thermal transfer image-receiving sheet were put on top of each other so that the dye layer faced the dye-receptive surface. Thermal transfer recording was carried out by means of a thermal head under the following conditions from the backside of the thermal transfer film in the order of Y, M, and C (printing condition A). Separately, after an image was recorded under the printing condition A, a protective layer was transferred onto the recorded image (printing condition B).

Printing Condition A

A black blotted image was formed by thermal transfer recording under the following conditions.

Thermal head: KYT-86-12 MFW 11, manufactured by Kyocera Corp.

Average resistance value of heating element: 4412Ω

Print density in scanning direction: 300 dpi

Print density in feed direction: 300 dpi

Applied power: 0.136 w/dot

One line period: 6 msec

Printing initiation temp.: 30° C.

Printing of black blotted image: A multipulse-type test printer was used wherein the number of divided pulses with a pulse length obtained by equally dividing one line period into 256 parts is variable from 0 to 255 during one line period. In this case, the duty ratio for each divided pulse was fixed to 70%, the number of pulses per line period was fixed to 255, and blotted images for Y, M, and C were successively printed.

Printing Condition B

A gradation image was formed by thermal transfer recording in the same manner as described above, except that gradation control was carried out as follows. Thereafter, a protective layer was transferred.

Gradation printing: A multipulse-type test printer was used wherein the number of divided pulses with a pulse length obtained by equally dividing one line period into 256 parts is variable from 0 to 255 during one line period. In this case, the duty ratio for each divided pulse was fixed to 40%, and, according to the gradation, the number of pulses per line period was brought to 0 for step 1, 17 for step 2, 34 for step 3 and the like. In this way, the number of pulses was successively increased from 0 to 255 by 17 for each step. Thus, 16 gradation steps from step 1 to step 16 were controlled to form a gradation image.

Transfer of protective layer: A multipulse-type test printer was used wherein the number of divided pulses with a pulse length obtained by equally dividing one line period into 256 parts is variable from 0 to 255 during one line period. In this case, the duty ratio for each divided pulse was fixed to 40%, the number of pulses per line period was fixed to 210, and a blotted image was printed to transfer a protective layer on the whole area of the surface of the print.

(1) Separability:

The prints produced under the printing condition A were visually inspected.

Evaluation criteria:

○ . . . No abnormal transfer phenomenon occurred.

Δ . . . No abnormal transfer phenomenon occurred, although a sound derived from separation occurred at the time of transfer.

X . . . An abnormal transfer phenomenon, wherein the receptive layer was transferred onto the thermal transfer sheet, or an abnormal transfer phenomenon, wherein the dye binder in the thermal transfer film was transferred onto the image-receiving face, occurred.

(2) Adhesion of Protective Layer:

After the protective layer was transferred under the printing condition B, a cellophane tape was applied to the protective layer transferred face and was separated again. In this case, the transfer of the protective layer in the print onto the tape was inspected.

Evaluation criteria:

○ . . . The protective layer remained adhered to the print side without transfer onto the tape side.

X . . . The protective layer did not remain fully adhered to the print side over the whole area.

(3) Foaming:

Each coating liquid was vigorously hand shaken for 10 sec, and the time necessary for defoaming was then measured.

Evaluation criteria:

○ . . . Deformed within 30 min.

Δ . . . Defoamed within one hr.

X . . . Not defoamed even after the elapse of one hr or longer.

<Results>

| | Separability | Adhesion of protective layer | Foaming | Overall evaluation |
|---|---|---|---|---|
| Ex. B1 | Δ | ○ | Δ | ○ |
| Ex. B2 | ○ | ○ | Δ | ⊚ |
| Ex. B3 | ○ | ○ | ○ | ⊚ |
| Ex. B4 | ○ | ○ | Δ | ⊚ |
| Ex. B5 | ○ | ○ | Δ | ⊚ |
| Ex. B6 | ○ | ○ | Δ | ⊚ |
| Ex. B7 | Δ | ○ | Δ | ○ |
| Ex. B8 | ○ | ○ | ○ | ⊚ |
| Ex. B9 | Δ | ○ | Δ | ○ |
| Ex. B10 | ○ | ○ | ○ | ⊚ |
| Ex. B11 | ○ | ○ | ○ | ⊚ |
| Ex. B12 | ○ | ○ | ○ | ⊚ |
| Ex. B13 | ○ | ○ | Δ | ○ |
| Ex. B14 | ○ | ○ | ○ | ⊚ |
| Ex. B15 | ○ | ○ | ○ | ⊚ |
| Ex. B16 | ○ | ○ | ○ | ⊚ |
| Ex. B17 | ○ | ○ | ○ | ⊚ |
| Ex. B18 | ○ | ○ | ○ | ⊚ |
| Comp. Ex. B1 | X | — | ○ | X |
| Comp. Ex. B2 | X | ○ | X | X |
| Comp. Ex. B3 | X | ○ | X | X |
| Comp. Ex. B4 | X | ○ | Δ | X |
| Comp. Ex. B5 | X | ○ | Δ | X |
| Comp. Ex. B6 | Δ | X | ○ | X |
| Comp. Ex. B7 | X | — | ○ | X |

As is apparent from the above examples and comparative examples, the present invention can provide a thermal transfer image-receiving sheet, which can satisfy both requirements for satisfactory separation from the thermal transfer sheet at the time of the formation of an image and good adhesion at the time of the transfer of a protective layer, without the use of any vinyl chloride resin. Further, after the formation of an image on an image receiving face in the thermal transfer image-receiving sheet, the transfer of a protective layer onto the image formed face can provide image formed object which has been improved in fastness or resistance properties including lightfastness and resistance to sebum.

EXAMPLE C

The following examples further illustrate the present invention.

Provision of Yellow Dyes

In quinophthalone dyes represented by formula (1), $R_1$ to $R_7$ were set as specified in Table C1 below to provide three yellow dyes (Y-1, Y-2, and Y-3).

TABLE C1

| Yellow dye | $R_1$ | $R_2$ | $R_3$ | $R_4$ | $R_5$ | $R_6$ | $R_7$ |
|---|---|---|---|---|---|---|---|
| Y-1 | H | H | H | H | H | H | $C_8H_{17}$ |
| Y-2 | Br | H | H | H | H | H | $C_6H_{13}$ |
| Y-3 | H | H | $C_3H_7$ | H | H | H | $C_6H_{14}$ |

Further, in dicyanostyryl dyes represented by formula (2), $R_1$ to $R_3$ and A were set as specified in Table C2 below to provide two yellow dyes (Y-4 and Y-5).

TABLE C2

| Yellow dye | $R_1$ | $R_2$ | $R_3$ | A |
|---|---|---|---|---|
| Y-4 | $C_4H_8$ | 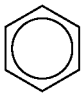 | $CH_3$ | $—C_2H_4—$ |
| Y-5 | $C_2H_8$ | 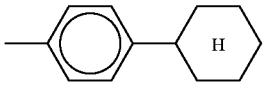 | $CH_3$ | $—C_2H_4O—$ |

Provision of Magenta Dyes

In imidazoleazo dyes represented by formula (3), R, $R_1$, $R_2$, Y, and X were set as specified in Table C3 below to provide two magenta dyes (M-1 and M-2).

TABLE C3

| Magenta dye | R | $R_1$ | $R_2$ | Y | X |
|---|---|---|---|---|---|
| M-1 | $CH_2CH{=}CH_2$ | $C_3H_7$ | $C_3H_7$ | $NHCOCH_3$ | H |
| M-2 | $C_4H_9$ | $C_4H_9$ | $C_4H_9$ | $NHCOCH_3$ | H |

Further, in anthraquinone dyes represented by formula (4), R, X, Y, and n were set as specified in Table C4 below to provide two magenta dyes (M-3 and M-4).

TABLE C4

| Magenta dye | R | X | Y | n |
|---|---|---|---|---|
| M-3 | H | $NH_2$ | $NH_2$ | 2 |
| M-4 | H | $NH_2$ | OH | 1 |

Provision of Cyan Dyes

In indoaniline dyes represented by formula (5), R, $R_1$ to $R_6$ were set as specified in Table C5 below to provide five cyan dyes (C-1, C-2, C-3, C-4, and C-5).

TABLE C5

| Cyan dye | R | $R_1$ | $R_2$ | $R_3$ | $R_4$ | $R_5$ | $R_6$ |
|---|---|---|---|---|---|---|---|
| C-1 | $CH_2$ | $CH_3$ | H | H | $CH_3$ | $C_2H_5$ | $C_2H_5$ |
| C-2 | $CH_2$ | $CH_3$ | H | H | H | $C_2H_5$ | $C_2H_5$ |
| C-3 | $CH_2$ | $CH_3$ | H | Cl | $CH_3$ | $C_2H_5$ | $C_2H_5$ |
| C-4 | $OC_2H_5$ | $CH_3$ | H | Cl | $CH_3$ | $C_2H_5$ | $C_2H_5$ |
| C-5 | 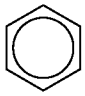 | $CH_3$ | H | C1 | $CH_3$ | $C_2H_5$ | $C_2H_5$ |

Further, in anthraquinone dyes represented by formula (6), $R_1$ and $R_2$ were set as specified in Table C6 below to provide one cyan dye (C-6).

TABLE C6

| Cyan dye | $R_1$ | $R_2$ |
|---|---|---|
| C-6 | $CH_3$ | 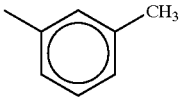 |

Measurement of Melting Point of Dyes

For each dye provided above, the melting point was measured according to JIS K 0064 (1992). The results are shown in Table C7 below.

TABLE C7

| Dye | m.p., ° C. |
|---|---|
| Y-1 | 157 |
| Y-2 | 156 |
| Y-3 | 144 |
| Y-4 | 89 |
| Y-5 | 115 |
| M-1 | 187 |
| M-2 | 134 |
| M-3 | 191 |
| M-4 | 182 |
| C-1 | 141 |
| C-2 | 128 |
| C-3 | 162 |
| C-4 | 116 |
| C-5 | 132 |
| C-6 | 149 |

Preparation of Thermal Transfer Sheets

An ink for a heat-resistant slip layer having the following composition was gravure coated onto one side of a 6 μm-thick polyethylene terephthalate film (Lumirror, manufactured by Toray Industries, Inc.), and the coating was dried to form a heat-resistant slip layer having a coating thickness of 1 μm on a dry basis. The coated polyethylene terephthalate film was further heated in an oven at 60° C. for 5 days to perform curing treatment.

| (Composition of ink for heat-resistant slip layer) | |
|---|---|
| Polyvinylbutyral (S-lec BX-1, manufactured by Sekisui Chemical Co., Ltd.) | 15 parts |
| Polyisocyanate (Burnock D 450, manufactured by Dainippon Ink and Chemicals, Inc.) | 35 parts |
| Phosphate surfactant (Plysurf A 208 S, manufactured by Dai-Ichi Kogyo Seiyaku Co., Ltd.) | 10 parts |
| Talc (Microace P-3, manufactured by Nippon Talc Co., Ltd.) | 3 parts |

Next, a coating liquid for a dye layer having the following composition was coated (coverage: 0.8 g/$m^2$ on a dry basis) by wire bar coating onto the surface of the polyethylene terephtalate film remote from the heat-resistant slip layer, and the coating was dried at 80° C. for one min to form a dye layer. In this way, 8 thermal transfer sheets (samples 1 to 8) were prepared. In this case, 8 dye compositions (D-1 to D-8) as specified in Table C8 below were used for respective coating liquids for a dye layer.

| (Composition of coating liquid for dye layer) | |
|---|---|
| Polyvinyl acetal resin (KS-5, manufactured by Sekisui Cheinical Co., Ltd.) | 3 parts |
| Dye | One of D-1 to D-8 |
| Methyl ethyl ketone/toluene (weight ratio = 1/1) | 90 parts |

TABLE C8

| Dye composition | Type of dye | Content, pts. wt. | Difference in m.p. between dyes having identical base skeleton |
|---|---|---|---|
| D-1 | Y-1 | 4.0 | Difference in m.p. between Y-4 and Y-5 = 26° C. |
| | Y-4 | 0.5 | |
| | Y-5 | 1.5 | |
| D-2 | M-1 | 2.5 | Difference in m.p. between M-1 and M-2 = 53° C. |
| | M-2 | 2.5 | |
| | M-4 | 1.0 | |
| D-3 | C-1 | 2.5 | Difference in m.p. between C-1 and C-2 = 13° C. |
| | C-2 | 1.5 | |
| | C-6 | 2.0 | |
| D-4 | Y-3 | 2.5 | Difference in m.p. between Y-2 and Y-3 = 12° C. |
| | Y-2 | 1.5 | |
| | Y-5 | 2.0 | |
| D-5 | C-1 | 2.5 | Difference in m.p. among C-1, C-3 and C-4 = 21 to 46° C. |
| | C-3 | 1.5 | |
| | C-4 | 0.5 | |
| | C-6 | 1.5 | |
| D-6 | Y-3 | 5.0 | No identical base skeleton |
| | Y-2 | 1.0 | |
| D-7 | M-1 | 3.0 | Difference in m.p. between M-3 and M-4 = 9° C. |
| | M-3 | 1.5 | |
| | M-4 | 1.5 | |
| D-8 | C-2 | 3.0 | Difference in m.p. between C-2 and C-5 = 5° C. |
| | C-5 | 1.0 | |
| | C-6 | 2.0 | |

Preparation of Thermal Transfer Sheet (Thermal Transfer Sheet Provided With Thermally Transferable Protective Layer)

A coating liquid for a release layer having the following composition was gravure coated (coverage: 0.5 g/$m^2$ on a dry basis) onto the surface of a polyethylene terephthalate film, provided with a heat-resistant slip layer, remote from the heat-resistant slip layer, and the coating was dried to form a release layer. A coating liquid for a protective layer having the following composition was gravure coated (coverage: 2 g/m$^2$ on a dry basis) onto the release layer, and the coating was dried to form a protective layer. Thus, a thermal transfer sheet provided with a thermally transferable protective layer was prepared.

| | |
|---|---|
| (Composition of coating liquid for release layer) | |
| Ionomer resin (Kemipearl S 659, manufactured by Mitsui Chemicals Inc.) | 10 parts |
| Water/ethanol (weight ratio = 2/3) | 100 parts |
| (Composition of coating liquid for protective layer) | |
| Vinyl chloride-vinyl acetate copolymer (Denka Vinyl #1000 ALK, manufactured by Denki Kagaku Kogyo K.K.) | 10 parts |
| Acrylic resin (Dianal BR-87, manufactured by Mitsubishi Rayon Co., Ltd.) | 10 parts |
| Benzotriazole ultraviolet absorber (TINUVIN 900, manufactured by CIBA-GEIGY Ltd.) | 5 parts |
| Methyl ethyl ketone/toluene (weight ratio = 1/1) | 80 parts |

Preparation of Thermal Transfer Image-receiving Sheets

A synthetic paper (YUPO FRG-150 (thickness 150 μm), manufactured by Yupo Corporation (Oji-Yuka) was provided as a substrate. A coating liquid for an intermediate layer having the following composition was coated (coverage: 1.0 g/m$^2$ on a dry basis) by wire bar coating onto one side of the substrate, and the coating was dried to form an intermediate layer.

| (Composition of coating liquid for intermediate layer) | |
|---|---|
| Polyester resin (Vylon 200, manufactured by Toyobo Co., Ltd.) | 10 parts |
| Titanium oxide (TCA-888, manufactured by Tohchem Products Corporation) | 20 parts |
| Methyl ethyl ketone/toluene (weight ratio = 1/1) | 120 parts |

Next, six coating liquids for a receptive layer (R-1 to R-6) having the following respective compositions were provided, and each coating liquid was coated (coverage: 2.5 g/m$^2$ on a dry basis) by wire bar coating onto the intermediate layer, and the coating was dried to form a receptive layer. Thus, six thermal transfer image-receiving sheets (samples A to F) were prepared.

| | |
|---|---|
| (Composition of coating liquid R-1 for receptive layer) | |
| Cellulose acetate butyrate (CAB 551-0.2, manufactured by Eastman Chemical Co.) | 30 parts |
| Cellulose acetate butyrate (CAB 321-0.1, manufactured by Eastman Chemical Co.) | 60 parts |
| Polycaprolactone (Placcel H5, manufactured by Daicel Chemical Industries, Ltd.) | 10 parts |
| Polyether-modified silicone (KF-6012, manufactured by The Shin-Etsu Chemical Co., Ltd.) | 0.5 part |
| Methyl ethyl ketone/toluene (weight ratio = 1/1) | 440 parts |

-continued

| | |
|---|---|
| (Composition of coating liquid R-2 for receptive layer) | |
| Cellulose acetate butyrate (CAB 551-0.2, manufactured by Eastman Chemical Co.) | 30 parts |
| Cellulose acetate butyrate (CAB 381-0.1, manufactured by Eastman Chemical Co.) | 50 parts |
| Acrylonitrile-styrene resin (Cevian JD, manufactured by Daicel Chemical Industries, Ltd.) | 30 parts |
| Polyether-modified silicone (KF-6012, manufactured by The Shin-Etsu Chemical Co., Ltd.) | 0.5 part |
| Methyl ethyl ketone/toluene (weight ratio = 1/1) | 440 parts |
| (Composition of coating liquid R-3 for receptive layer) | |
| Cellulose acetate butyrate (CAB 551-0.2, manufactured by Eastman Chemical Co.) | 30 parts |
| Cellulose acetate butyrate (CAD 381-0.1, manufactured by Eastman Chemical Co.) | 30 parts |
| Acrylonitrile-styrene resin (Cevian JD, manufactured by Daicel Chemical Industries, Ltd.) | 30 parts |
| Polycaprolactone (Placcel H5, manufactured by Daicel Chemical Industries, Ltd.) | 10 parts |
| Polyether-modified silicone (KF-6012, manufactured by The Shin-Etsu Chemical Co., Ltd.) | 0.5 part |
| Methyl ethyl ketone/toluene (weight ratio = 1/1) | 440 parts |
| (Composition of coating liquid R-4 for receptive layer) | |
| Vinyl chloride-vinyl acetate copolymer (Denka vinyl #1000 A, manufactured by Denki Kagaku Kogyo K.K.) | 70 parts |
| Epoxy-modified silicone (X-22-3000 T, manufactured by The Shin-Etsu Chemical Co., Ltd.) | 10 parts |
| Methyl ethyl ketone/toluene (weight ratio = 1/1) | 400 parts |
| (Composition of coating liquid R-5 for receptive layer) | |
| Aromatic saturated polyester resin (vylon 200, manufactured by Toyobo Co., Ltd.) | 70 parts |
| Epoxy-modified silicone (X-22-3000 T, manufactured by The Shin-Etsu Chemical Co., Ltd.) | 10 parts |
| Methyl ethyl ketone/toluene (weight ratio = 1/1) | 400 parts |
| (Composition of coating liquid R-6 for receptive layer) | |
| Acrylonitrile-styrene copolymer (Cevian JD, manufactured by Daicel Chemical Industries, Ltd.) | 80 parts |
| Polycaprolactone (Placcel H7, manufactured by Daicel Chemical Industries, Ltd.) | 20 parts |
| Epoxy-modified silicone (X-22-3000 T, manufactured by The Shin-Etsu Chemical Co., Ltd.) | 5 parts |
| Methyl ethyl ketone/toluene (weight ratio = 1/1) | 400 parts |

Image Formation

The eight thermal transfer sheets (samples 1 to 8) and the six thermal transfer image-receiving sheets (samples A to F) thus prepared were used in combination as specified in Tables C8 to C10 below. The thermal transfer image-receiving sheet and the thermal transfer sheet were put on top of each other so that the surface of the receptive layer in the thermal transfer image-receiving sheet faced the surface of the dye layer in the thermal transfer sheet. Thermal transfer recording was carried out from the heat-resistant slip layer side of the thermal transfer sheet under the following conditions to form gradation images (Examples C1 to C15 and Comparative Examples C1 to C33).

(Conditions for Thermal Transfer)

Thermal head: KGT-217-12 MPL 20, manufactured by Kyocera Corp.

Average resistance value of heating element: 3195Ω

Print density in scanning direction: 300 dpi

Print density in feed direction: 300 dpi

Applied power: 0.15 W/dot

One line period: 6 msec

Printing initiation temp.: 40° C.

Gradation control method: A multipulse-type test printer was used wherein the number of divided pulses with a pulse length obtained by equally dividing one line period into 256 parts is variable from 0 to 255 during one line period. In this case, the duty ratio for each divided pulse was fixed to 35%, and, according to the gradation, the number of pulses per line period was brought to 0 for step 0, 17 for step 1, 34 for step 2 and the like. In this way, the number of pulses was successively increased from 0 to 255 by 17 for each step. Thus, 16 gradation steps from step 0 to step 15 were controlled to form a gradation image.

Transfer of protective Layer

Next, the thermal transfer sheet provided with a transferable protective layer was put on top of the printed face so that the surface of the protective layer covered the printed face, and the protective layer was transferred onto the whole printed face. In this case, the protective layer was transferred in the same manner as used in the formation of the image, except that the gradation was controlled by the following method.

(Conditions for Thermal Transfer)

Gradation control method: A multipulse-type test printer was used wherein the number of divided pulses with a pulse length obtained by equally dividing one line period into 256 parts is variable from 0 to 255 during one line period. In this case, the duty ratio for each divided pulse was fixed to 35%, the number of pulses per line period was fixed to 210, and a blotted image was printed to transfer a protective layer onto the printed face.

Evaluation

The thermal transfer sheets and the prints (Examples C1 to C15 and Comparative Examples C1 to C33) were evaluated by the following methods for print density, lightfastness, anti-kickback property, and a difference in density between before and after the storage of the thermal transfer sheet. The results are shown in Tables C9 to C11 below.

(Evaluation of Print Density)

For the prints prepared above, the optical reflection density (OD) was measured with a Macbeth reflection densitometer manufactured by Gretag-Macbeth, and the results were evaluated according to the following criteria.

Evaluation Criteria

Prints (Examples 1 to 3 and 10 to 12 and Comparative Examples 1 to 3, 10 to 12, 16 to 18, 20, and 21) prepared using thermal transfer sheets provided with a yellow dye layer (samples 1, 4, and 6) were evaluated based on Comparative Example 19.

Prints (Examples C4 to C6 and Comparative Examples C4 to C6, C22 to C24, C26, and C27) prepared using thermal transfer sheets provided with a magenta dye layer (samples 2 and 7) were evaluated based on Comparative Example C25.

Prints (Examples C7 to C9 and C13 to C15 and Comparative Examples C7 to C9, C13 to C15, C28 to C30, C32, and C33) prepared using thermal transfer sheets provided with a cyan dye layer (samples 3, 5, and 8) were evaluated based on Comparative Example C31.

◎: OD of not less than 110% in the same step as the step of the comparative example as the reference which provided OD≈1.0.

○: OD of not less than 100% and less than 110% in the same step as the step of the comparative example as the reference which provided OD≈1.0.

Δ: OD of not less than 90% and less than 100% in the same step as the step of the comparative example as the reference which provided OD≈1.0.

X: OD of less than 90% in the same step as the step of the comparative example as the reference which provided OD≈1.0.

(Evaluation of Lightfastness)

The prints thus prepared were exposed under the following conditions.

Irradiation tester: Ci 135, manufactured by Atlas

Light source: Xenon lamp

Filter: Inner side=IR filter, outer side=soda-lime glass

Black panel temp.: 45° C.

Irradiation intensity: 12 W/m$^2$ . . . value as measured at 420 nm

Irradiation energy: 200 kJ/m$^2$ . . . value as measured at 420 nm

Thereafter, in the step which provided OD≈1.0, a difference in OD between before and after the irradiation was measured. The retention (%) was then calculated by the following equation. The results were evaluated according to the following criteria.

Retention (%)=[(OD after irradiation)/(OD before irradiation)]×100

Evaluation Criteria:

◎: Retention of not less than 90%

○: Retention of not less than 80% and less than 90%

Δ: Retention of not less than 70% and less than 80%

X: Retention of less than 70%

(Evaluation of Anti-kickback Property)

In the thermal transfer sheets prepared above, the dye layer was put on top of the heat-resistant slip layer. The assembly was stored under conditions of load 2 kgf/cm$^2$ and temperature 50° C. for 100 hr to transfer (kick) the dye onto the heat-resistant slip layer. Next, the heat-resistant slip layer with the dye transferred thereon was put on top of the protective layer in the thermal transfer sheet provided with a transferable protective layer. The assembly was stored under conditions of load 2 kgf/cm$^2$ and temperature 60° C. for 4 hr to transfer (back) the dye onto the protective layer.

Next, the protective layer with the dye transferred (backed) thereonto and the protective layer with no dye transferred (backed) thereonto were transferred onto a substrate with no image printed thereon (a specialty paper CAMEDIA P-330, manufactured by Olympus Optical Co., LTD.). Both the substrates with the protective layer transferred thereon were measured for OD. The anti-kickback property (ΔODKB) was determined by the following equation. The results were evaluated according to the following criteria. In this case, OD was measured using a filter corresponding to the transferred dye color.

$\Delta OD_{KB}$=(OD value in backed situation)−(OD value in non-backed situation)

Evaluation Criteria

◎: $\Delta OD_{KB}$ of less than 0.03, indicating that the anti-kickback property is very good.

○: $\Delta OD_{KB}$ of not less than 0.03 and less than 0.06, indicating that the anti-kickback property is good.

Δ: $\Delta OD_{KB}$ of not less than 0.06 and less than 0.10, indicating that the anti-kickback property is somewhat poor.

X: $\Delta OD_{KB}$ of not less than 0.10, indicating that the anti-kickback property is poor.

(Difference in Density Between Before and After Storage of Thermal Transfer Sheet)

The thermal transfer sheets prepared above were stored at a temperature of 60° C. for 48 hr. The thermal transfer sheets after the storage and the thermal transfer sheets, which were not stored, were used to print a gradation image onto the thermal transfer image-receiving sheet (R-1) by means of CAMEDIA P-330, manufactured by Olympus Optical Co., LTD. Thereafter, OD was measured in the same step as the step in the print of the non-stored thermal transfer sheet which provided OD≈0.3. The difference in density between before and after the storage of the thermal transfer sheet ($\Delta OD_{ST}$) was determined by the following equation. The results were evaluated according to the following criteria.

$\Delta OD_{ST}$=(OD for stored thermal transfer sheet)−(OD for non-stored thermal transfer sheet)

Evaluation Criteria

○: $\Delta OD_{ST}$ of less than 0.08, indicating that the difference in density was small.

Δ: $\Delta OD_{ST}$ of not less than 0.08 and less than 0.15, indicating that there was some density difference.

X: $\Delta OD_{ST}$ of not less than 0.15, indicating that the difference in density was large.

TABLE C9

| Print | Thermal transfer sheet (dye composition) | Thermal transfer image-receiving sheet (coating liquid used) | Print density | Light-fastness | $\Delta OD_{KB}$ | $\Delta OD_{ST}$ |
|---|---|---|---|---|---|---|
| Ex. C1 | Sample 1 | Sample A (R-1) | ○ | ◎ | ○ | ○ |
| Ex. C2 | (D-1) | Sample B (R-2) | ○ | ◎ | | |
| Ex. C3 | (Yellow) | Sample C (R-3) | ○ | ◎ | | |
| Ex. C4 | Sample 2 | Sample A (R-1) | ◎ | ◎ | ○ | ○ |
| Ex. C5 | (D-2) | Sample B (R-2) | ◎ | ◎ | | |
| Ex. C6 | (Magenta) | Sample C (R-3) | ◎ | ◎ | | |
| Ex. C7 | Sample 3 | Sample A (R-1) | ○ | ○ | ○ | ○ |
| Ex. C8 | (D-3) | Sample B (R-2) | ○ | ○ | | |
| Ex. C9 | (Cyan) | Sample C (R-3) | ○ | ○ | | |
| Ex. C10 | Sample 4 | Sample A (R-1) | ○ | ○ | ◎ | ○ |
| Ex. C11 | (D-4) | Sample B (R-2) | ○ | ○ | | |
| Ex. C12 | (Yellow) | Sample C (R-3) | ○ | ○ | | |
| Ex. C13 | Sample 5 | Sample A (R-1) | ○ | ○ | ○ | ○ |
| Ex. C14 | (D-5) | Sample B (R-2) | ○ | ○ | | |
| Ex. C15 | (Cyan) | Sample C (R-3) | ○ | ○ | | |

TABLE C10

| Print | Thermal transfer sheet (dye composition) | Thermal transfer image-receiving sheet (coating liquid used) | Print density | Light-fastness | $\Delta OD_{KB}$ | $\Delta OD_{ST}$ |
|---|---|---|---|---|---|---|
| Comp. Ex. C1 | Sample 1 | Sample D (R-4) | ○ | Δ | ○ | ○ |
| Comp. Ex. C2 | (D-1) | Sample E (R-5) | Δ | ◎ | | |
| Comp. Ex. C3 | (Yellow) | Sample F (R-6) | ○ | Δ | | |
| Comp. Ex. C4 | Sample 2 | Sample D (R-4) | ○ | Δ | ○ | ○ |
| Comp. Ex. C5 | (D-2) | Sample E (R-5) | Δ | ○ | | |
| Comp. Ex. C6 | (Magenta) | Sample F (R-6) | Δ | X | | |
| Comp. Ex. C7 | Sample 3 | Sample D (R-4) | ○ | Δ | ○ | ○ |
| Comp. Ex. C8 | (D-3) | Sample E (R-5) | Δ | ○ | | |
| Comp. Ex. C9 | (Cyan) | Sample F (R-6) | ○ | X | | |
| Comp. Ex. C10 | Sample 4 | Sample D (R-4) | ◎ | X | ◎ | ○ |
| Comp. Ex. C11 | (D-4) | Sample E (R-5) | Δ | Δ | | |
| Comp. Ex. C12 | (Yellow) | Sample F (R-6) | ○ | X | | |
| Comp. Ex. C13 | Sample 5 | Sample D (R-4) | ○ | Δ | ○ | ○ |
| Comp. Ex. C14 | (D-5) | Sample E (R-5) | Δ | ○ | | |
| Comp. Ex. C15 | (Cyan) | Sample F (R-6) | ○ | X | | |

TABLE C11

| Print | Thermal transfer sheet (dye composition) | Thermal transfer image-receiving sheet (coating liquid used) | Print density | Light-fastness | $\Delta OD_{KB}$ | $\Delta OD_{ST}$ |
|---|---|---|---|---|---|---|
| Comp. Ex. C16 | Sample 6 | Sample A (R-1) | Δ | ◎ | ◎ | X |
| Comp. Ex. C17 | (D-6) | Sample B (R-2) | Δ | ◎ | | |
| Comp. Ex. C18 | (Yellow) | Sample C (R-3) | Δ | ◎ | | |

TABLE C11-continued

| Print | Thermal transfer sheet (dye composition) | Thermal transfer image-receiving sheet (coating liquid used) | Print density | Light-fastness | $\Delta OD_{KB}$ | $\Delta OD_{ST}$ |
|---|---|---|---|---|---|---|
| Comp. Ex. C19 | | Sample D (R-4) | Reference | ○ | | |
| Comp. Ex. C20 | | Sample E (R-5) | Δ | ◎ | | |
| Comp. Ex. C21 | | Sample F (R-6) | ○ | ○ | | |
| Comp. Ex. C22 | Sample 7 | Sample A (R-1) | Δ | ◎ | Δ | X |
| Comp. Ex. C23 | (D-7) | Sample B (R-2) | Δ | ◎ | | |
| Comp. Ex. C24 | (Magenta) | Sample C (R-3) | Δ | ◎ | | |
| Comp. Ex. C25 | | Sample D (R-4) | Reference | ◎ | | |
| Comp. Ex. C26 | | Sample E (R-5) | Δ | ◎ | | |
| Comp. Ex. C27 | | Sample F (R-6) | ○ | ○ | | |
| Comp. Ex. C28 | Sample 8 | Sample A (R-1) | Δ | Δ | X | Δ |
| Comp. Ex. C29 | (D-8) | Sample B (R-2) | Δ | Δ | | |
| Comp. Ex. C30 | (Cyan) | Sample C (R-3) | Δ | Δ | | |
| Comp. Ex. C31 | | Sample D (R-4) | Reference | X | | |
| Comp. Ex. C32 | | Sample E (R-5) | Δ | X | | |
| Comp. Ex. C33 | | Sample F (R-6) | Δ | X | | |

As is apparent from Table 9, the prints prepared using the thermal transfer recording materials according to the present invention had satisfactory print density and further had excellent lightfastness. Further, it was confirmed that the thermal transfer sheets constituting the thermal transfer recording materials according to the present invention were free from kickback-derived contamination and, even after storage for a long period of time, there was no change in print density.

On the other hand, as is apparent from Tables 10 and 11, when at least one of the thermal transfer sheet and the thermal transfer image-receiving sheet constituting the thermal transfer recording material was outside the scope of the present invention, at least one of deteriorated print density, deteriorated lightfastness, occurrence of kickback, and change in print density after long-term storage occurred.

As is apparent from the foregoing detailed description, according to the present invention, dyes, which have a predetermined relationship between the basic skeleton and the melting point, are contained in the dye layer in the thermal transfer film, and the receptive layer in the thermal transfer image-receiving sheet is a cellulose ester resin. Both the thermal transfer sheet and the thermal transfer image-receiving sheet constituting the thermal transfer recording material are set to optimal states. By virtue of this, the thermal transfer recording material can satisfy requirements for an increase in printing speed at the time of thermal transfer and a higher level of properties required of media and consequently can provide satisfactory print density, is free from kickback-derived contamination, is free from a change in print density even after long-term storage, and can realize prints having satisfactory quality.

EXAMPLES D (Production of Substrate)

Constituent materials shown in Table D1 were adhered to and stacked on top of one another by dry lamination with the aid of a polyurethane resin as an adhesive to prepare substrates 1 to 3.

TABLE D1

| | Surface layer | Core layer | Backside layer |
|---|---|---|---|
| Substrate 1 | Porous PET; thickness: 75 μm | Coated paper; basis weight: 72.3 g/m$^2$ | Porous PET; thickness: 75 μm |

TABLE D1-continued

| | Surface layer | Core layer | Backside layer |
|---|---|---|---|
| Substrate 2 | Porous PET; thickness: 75 μm | None | Porous PET; thickness: 75 μm |
| Substrate 3 | Porous PP; thickness: 60 μm | Coated paper; basis weight: 72.3 g/m$^2$ | Porous PP; thickness: 60 μm |

(Formation of Colorant-receptive Layer)

A coating liquid having the following composition was coated onto one side of the substrate by gravure reverse coating to form an intermediate layer at a coverage of 2.0 g/m$^2$ on a dry basis, and a colorant-receptive layer was then formed thereon at a coverage of 4.0 g/m$^2$ on a dry basis to prepare a contemplated thermal transfer image-receiving sheet.

| | |
|---|---|
| (Coating liquid for intermediate layer) | |
| Polyurethane resin (Nippollan 2301, manufactured by Nippon Polyurethane Industry Co., Ltd.) | 5 parts |
| Titanium oxide (average particle diameter 2 μm) | 15 parts |
| Solvent (toluene:methyl ethyl ketone = 1:1) | 80 parts |
| (Coating liquid for colorant-receptive layer) | |
| vinyl chloride-vinyl acetate copolymer resin (#1000 A, manufactured by Denki Kagaku Kogyo K.K.) | 20 parts |
| Silicone resin (X·22·3000 E, manufactured by The Shin-Etsu Chemical Co., Ltd.) | 1 part |
| Silicone resin (X·22·3050 E, manufactured by The Shin-Etsu Chemical Co., Ltd.) | 1 part |
| Solvent (toluene:methyl ethyl ketone = 1:1) | 80 parts |

(Punching)

A blade tool was prepared so that four corners of the image-receiving paper had a specific shape, followed by punching to prepare an image-receiving sheet having a size of 140 mm in length×100 mm in width shown in Table D2.

(Measurement of Rigidity)

The rigidity in long side direction was measured with a garage-type rigidity tester.

(Vibration Test)

50 sheets of the image-receiving paper were put on top of one another and were placed in a box having a size of 150 mm in length×110 mm in width×50 mm in depth, and reciprocation was repeated 100 times at a turn-back acceleration of 2G.

(Printing Test)

A black image having a reflection density of 0.5 was printed by means of a printer. Printing was continuously carried out on 50 sheets of the image-receiving paper. The results were evaluated according to the following criteria.

Sheet feedability: When printing could be continuously carried out on 50 sheets of the image-receiving paper, the sheet feedability was evaluated as "○" while when sheet feed error occurred in a number of fed sheets of not more than 50, the sheet feedability was evaluated as "X."

Appearance of printed face: When no uneven density was found in the visual inspection of the printed face, the appearance of the printed face was evaluated as "○", while when uneven density attributable to damage to the image-receiving face was found in the visual inspection of the printed face, the appearance of the printed face was evaluated as "X."

| | | | | | |
|---|---|---|---|---|---|
| Ex. D2 | Substrate 1 | 3 | 950 | ○ | ○ |
| Ex. D3 | Substrate 1 | 5 | 950 | ○ | ○ |
| Ex. D4 | Substrate 2 | 1 | 1530 | ○ | ○ |
| Ex. D5 | Substrate 2 | 3 | 1530 | ○ | ○ |
| Ex. D6 | Substrate 2 | 5 | 1530 | ○ | ○ |
| Comp. Ex. D1 | Substrate 1 | 0 | 950 | ○ | X |
| Comp. Ex. D2 | Substrate 2 | 0 | 1530 | ○ | X |
| Comp. Ex. D3 | Substrate 1 | 10 | 950 | X | ○ |
| Comp. Ex. D4 | Substrate 2 | 7 | 1530 | X | ○ |
| Comp. Ex. D5 | Substrate 3 | 0 | 660 | ○ | ○ |

What is claimed is:

1. A thermal transfer image-receiving sheet comprising: a substrate sheet; and a receptive layer provided on at least one side of the substrate sheet, said receptive layer comprising at least a combination of a cellulose ester resin (A) having a degree of acetylation of 10 to 30% with a cellulose ester resin (B) having a degree of acetylation of less than 6%, the total degree of acetylation of the cellulose ester resin (A) and the cellulose ester resin (B) being 8 to 14%, the content of hydroxyl groups in the cellulose ester resin (A) and the content of hydroxyl groups in the cellulose ester resin (B) each being not more than 6% by weight, the remaining hydroxyl groups having been esterified with an organic acid excluding acetic acid.

2. The thermal transfer image-receiving sheet according to claim 1, wherein the organic acid is propionic acid and/or butyric acid.

3. The thermal transfer image-receiving sheet according to claim 1, wherein the receptive layer further comprises a compatible thermoplastic resin.

4. The thermal transfer image-receiving sheet according to claim 1, wherein the receptive layer comprises at least one plasticizer selected from the group consisting of phthalic acid plasticizers, phosphate plasticizers, polycaprolactones, and polyester plasticizers and the content of the plasticizer is not more than 15% by weight based on the total weight of the plasticizer and the resins constituting the receptive layer.

5. The thermal transfer image-receiving sheet according to claim 1, wherein the receptive layer comprises at least one release agent.

6. The thermal transfer image-receiving sheet according to claim 5, wherein the release agent comprises at least a modified silicone oil and/or a cured product thereof, a fluorosurfactant, and/or a silicone surfactant.

7. The thermal transfer image-receiving sheet according to claim 6, wherein the silicone surfactant is a polyether-modified silicone.

8. A print produced by forming an image on an image-receiving face of the thermal transfer image-receiving sheet according to claim 1 and then transferring a protective layer onto the image formed face.

9. A thermal transfer image-receiving sheet comprising: a substrate sheet; and a dye-receptive layer provided on at least one side of the substrate sheet, said dye-receptive layer containing, at least in its outermost surface portion, at least one polyether-modified silicone selected from the group consisting of polyether-modified silicones represented by formulae (B1), (B2), and (B3), said polyether-modified silicones having a siloxane content of 25 to 65% by weight:

(B1)

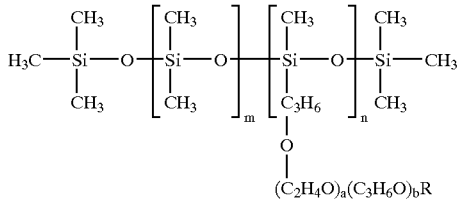

wherein polyether-modified silicones represented by formula (B1) are of grafting type, R represents H, an aryl group, or a straight-chain or branched alkyl group optionally substituted by a cycloalkyl group, m and n are each an integer of not more than 2000, and a and b are each an integer of 1 to 30;

(B2)

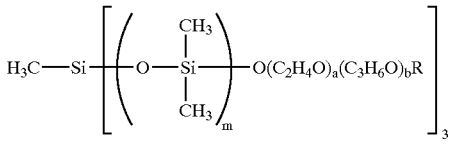

wherein polyether-modified silicones represented by formula (B2) are of end modification type, R represents H, an aryl group, or a straight-chain or branched alkyl group optionally substituted by a cycloalkyl group, m is an integer of not more than 2000, and a and b are each an integer of 1 to 30; and (B3)

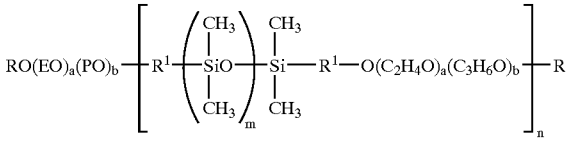

wherein polyether-modified silicones represented by formula (B3) are of main chain copolymerization type, R represents H, an aryl group, or a straight-chain or branched alkyl group optionally substituted by a cycloalkyl group, $R^1$ represents an aryl group or a straight-chain or branched alkyl group optionally substituted by a cycloalkyl group, m and n are each an integer of not more than 2000, and a and b are each an integer of 1 to 30.

10. The thermal transfer image-receiving sheet according to claim 9, wherein the weight ratio of ethylene oxide (EO) to propylene oxide (PO), EO/PO, in the polyether-modified silicones is 35/65 to 65/35.

11. The thermal transfer image-receiving sheet according to claim 9, wherein the polyether-modified silicone is contained in an amount of not more than 10% by weight based on 100 parts by weight of the resin component constituting the dye-receptive layer.

12. The thermal transfer image-receiving sheet according to claim 9, wherein the dye-receptive layer further comprises an epoxy-modified silicone and/or a methylstyrene-modified silicone.

13. The thermal transfer image-receiving sheet according to claim 9, wherein the polyether-modified silicone has an HLB value of not less than 9.

14. The thermal transfer image-receiving sheet according to claim 9, wherein the resin component constituting the dye-receptive layer is a thermoplastic resin selected from the group consisting of acrylic resin, styrene resin, acryl-styrene resin, acrylonitrile-styrene resin, polycarbonate resin, cellulose ester resin, and mixtures of said resins.

15. An image formed object produced by forming an image on an image-receiving face of the thermal transfer image-receiving sheet according to claim 9 and then transferring a protective layer onto the image formed face.

16. A thermal transfer recording material comprising: a thermal transfer sheet comprising a substrate sheet and a dye layer provided on at least one side of the substrate sheet; and a thermal transfer image-receiving sheet comprising a substrate and a receptive layer provided on at least one side of the substrate, a dye contained in the dye layer in the thermal transfer sheet being transferable onto the receptive layer in the thermal transfer image-receiving sheet by putting the thermal transfer sheet and the thermal transfer image-receiving sheet on top of each other, so that the dye layer faces the receptive layer, and heating the assembly by heating means, said dye layer comprising at least dyes and a binder resin, said dyes including at least two or more dyes having an identical basic skeleton, said dyes having an identical basic skeleton including at least one combination of dyes which are different from each other in melting point by 10° C. or above, said receptive layer comprising a cellulose ester resin.

17. The thermal transfer recording material according to claim 16, wherein said dyes are yellow dyes having a basic skeleton selected from quinophthalone dyes represented by formula (C1) and dicyanostyryl dyes represented by formula (C2):

(C1)

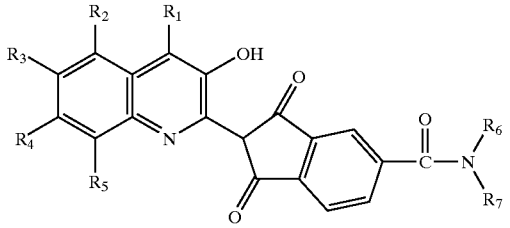

wherein $R_1$, $R_2$, $R_3$, $R_4$, and $R_5$ each independently represent a hydrogen atom, a halogen atom, a $C_1$ to $C_8$ alkyl group, a cycloalkyl group, an alkoxy group, an alkoxyalkyl group, an alkoxycarbonyl group, a thioalkoxy group, an alkylsulfonyl group, an amino group, a substituted or unsubstituted phenoxy group, or a substituted or unsubstituted thiophenoxy group, and $R_6$ and $R_7$ each independently represent a hydrogen atom, an alkyl group, an alkoxyalkyl group, a cycloalkyl group, an allyl group, an optionally substituted aryl group, an aralkyl group, a furfuryl group, a tetrahydrofurfuryl group, or a hydroxyalkyl group; and (C2)

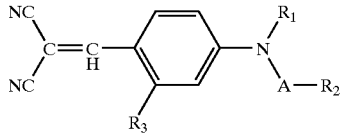

wherein $R_1$ represents an allyl group or an alkyl group, $R_2$ represents a substituted or unsubstituted alkyl group or an aryl group, A represents $—CH_2—$, $—CH_2CH_2—$, $—CH_2CH_2O—$, $—CH_2CH_2OCH_2—$, or $—CH_2CH_2OCH_2CH_2—$, and $R_3$ represents an alkyl group.

18. The thermal transfer recording material according to claim 16, wherein said dyes are magenta dyes having a basic skeleton selected from imidazoleazo dyes represented by formula (C3) and anthraquinone dyes represented by formula (C4):

(C3)

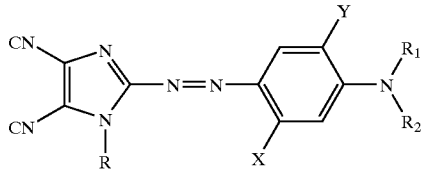

wherein R represents an alkyl group, an alkenyl group, an aryl group, a cyanoalkyl group, or a substituted or unsubstituted alkoxycarbonylalkyl group, $R_1$ and $R_2$ represent an alkenyl group, an aralkyl group, or a substituted or unsubstituted alkyl group, X represents a hydrogen atom, a methyl group, a methoxy group, a formylamino group, an alkylcarbonylamino group, an alkylsulfonylamino group, or an alkoxycarbonylamino group, and Y represents a hydrogen atom, a methyl group, a methoxy group, or a halogen atom; and (C4)

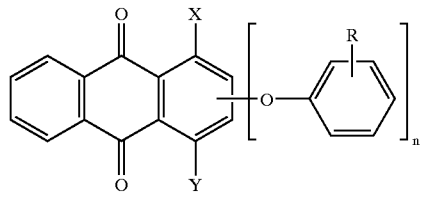

wherein R represents a hydrogen atom, a hydroxyl group, a substituted or unsubstituted alkyl group, or a substituted or unsubstituted alkoxy group, X and Y represent an amino group or a hydroxyl group, and n is 1 or 2.

19. The thermal transfer recording material according to claim 16, wherein said dyes are cyan dyes having a basic skeleton selected from indoaniline dyes represented by formula (C5) and anthraquinone dyes represented by formula (C6):

(C5)

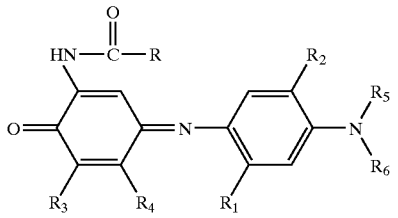

wherein $R_1$ represents a hydrogen atom; an alkyl group optionally substituted by a fluorine atom; an alkoxy group, an alkylamino group; an alkylcarbonylamino group optionally substituted by a fluorine atom; or a halogen atom, $R_2$ represents a hydrogen atom; an alkyl group optionally substituted by a fluorine atom; an alkoxy group; or a halogen atom, $R_3$ and $R_4$ represent a hydrogen atom; an alkyl group optionally substituted by a fluorine atom; an alkoxy group; or a halogen atom, and R, $R_5$, and $R_6$ represent a hydrogen atom, a $C_1$ to $C_6$ substituted or unsubstituted alkyl group, an aryl group, or an alkoxy group; and (C6)

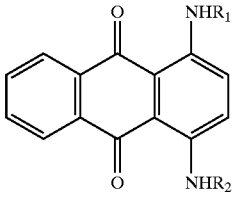

wherein $R_1$ and $R_2$ represent a substituted or unsubstituted alkyl group, a substituted or unsubstituted aryl group, a substituted or unsubstituted allyl group, or a substituted or unsubstituted aralkyl group.

20. The thermal transfer recording material according to claim 16, wherein the thermal transfer sheet comprises a yellow dye layer, a magenta dye layer, and a cyan dye layer provided in a face serial manner on the substrate sheet, the yellow dye layer comprises at least yellow dyes according to claim 17, the magenta dye layer comprises at least magenta dyes according to claim 18, and the cyan dye layer comprises at least cyan dyes according to claim 19.

21. The thermal transfer recording material according to claim 16, wherein the binder resin contained in the dye layer is any one of polyvinyl acetal resin and polyvinyl butyral resin.

22. The thermal transfer recording material according to claim 16, wherein the thermal transfer sheet comprises the dye layer and a transferable protective layer provided in a face serial manner on the substrate sheet.

23. The thermal transfer recording material according to claim 16, wherein, in the thermal transfer image-receiving sheet, the receptive layer contains a thermoplastic resin compatible with the cellulose ester resin.

24. The thermal transfer recording material according to claim 16, wherein, in the thermal transfer image-receiving sheet, the receptive layer contains not more than 15% by weight of at least one plasticizer selected from phthalic acid plasticizers, phosphate plasticizers, polycaprolactones, and polyester plasticizers.

* * * * *

UNITED STATES PATENT AND TRADEMARK OFFICE

CERTIFICATE OF CORRECTION

PATENT NO. : 6,692,879 B2
DATED : February 17, 2004
INVENTOR(S) : Shino Suzuki et al.

It is certified that error appears in the above-identified patent and that said Letters Patent is hereby corrected as shown below:

Title page,
Item [30], Foreign Application Priority Data, change "March 31, 2002" to
-- January 31, 2002 --

Signed and Sealed this

Twenty-seventh Day of April, 2004

JON W. DUDAS
*Acting Director of the United States Patent and Trademark Office*